US007260951B2

(12) United States Patent
Monk et al.

(10) Patent No.: US 7,260,951 B2
(45) Date of Patent: Aug. 28, 2007

(54) PRESSURE EQUALIZATION SYSTEM

(75) Inventors: David T. Monk, Bristol, VA (US); John W. Tolbert, Jr., Bristol, TN (US); John Kenneth Narney, II, Bristol, VA (US); Charles E. Zimmerman, Bristol, TN (US); Timothy M. Wampler, Bluff City, TN (US); Richard L. Smith, Kingsport, TN (US)

(73) Assignee: Bristol Compressors International, Inc., Bristol, VA (US)

( * ) Notice: Subject to any disclaimer, the term of this patent is extended or adjusted under 35 U.S.C. 154(b) by 319 days.

(21) Appl. No.: 10/967,431

(22) Filed: Oct. 18, 2004

(65) Prior Publication Data

US 2005/0066673 A1 Mar. 31, 2005

Related U.S. Application Data

(63) Continuation-in-part of application No. 10/194,501, filed on Jul. 12, 2002, now Pat. No. 6,823,686, which is a continuation-in-part of application No. 09/826,106, filed on Apr. 5, 2001, now Pat. No. 6,584,791.

(51) Int. Cl.
*F25B 41/00* (2006.01)

(52) U.S. Cl. ..... 62/196.3; 62/498

(58) Field of Classification Search ..... 62/498, 62/196.3

See application file for complete search history.

(56) References Cited

U.S. PATENT DOCUMENTS 2,080,288 A 5/1937 McCormack et al.
2,314,591 A 3/1943 McCormack et al.
3,601,506 A 8/1971 Griswold
3,698,839 A 10/1972 Distefano
3,855,813 A * 12/1974 St. Laurent ..... 62/196.3
4,026,122 A 5/1977 Kuhn et al.
4,270,885 A 6/1981 Shaffer et al.
4,298,314 A 11/1981 Thayer
4,373,870 A 2/1983 Pandzik
4,382,370 A 5/1983 Suefuji et al.
4,470,428 A 9/1984 Bishop et al.

(Continued)

FOREIGN PATENT DOCUMENTS

DE 8016104 U 9/1980

(Continued)

*Primary Examiner*—Melvin Jones
(74) *Attorney, Agent, or Firm*—McNees Wallace & Nurick LLC

(57) ABSTRACT

A pressure equalization system staffs a compressor while maintaining the condenser at a high pressure, including a valve and a bleed port. The compressor inlet receives a fluid at a first pressure. The compressor outlet discharges the fluid at a second pressure, and is operable to compress the fluid from the first pressure to the second pressure. The valve, proximate to and in fluid communication with the compressor outlet, is movable to an open position during compressor operation to permit the fluid at the second pressure to flow through the valve and is movable to a closed position when the compressor stops operating to prevent backflow of the fluid at the second pressure through the valve toward the compressor inlet. The bleed port, upstream of the valve and in fluid communication with the compressor inlet, equalizes the pressure of the fluid contained in the compressor when compressor operation stops.

27 Claims, 20 Drawing Sheets

U.S. PATENT DOCUMENTS

| | | | | |
|---|---|---|---|---|
| 4,593,535 | A | 6/1986 | Ikeda et al. | |
| 4,830,582 | A | 5/1989 | Asami et al. | |
| 5,141,420 | A | 8/1992 | Nambiar | |
| 5,395,214 | A | 3/1995 | Kawahara et al. | |
| 5,651,267 | A | 7/1997 | Todescat et al. | |
| 5,832,737 | A | 11/1998 | Moilanen | |
| 5,911,562 | A | 6/1999 | Murphy et al. | |
| 6,227,812 | B1 * | 5/2001 | Kawaguchi et al. | 417/222.2 |
| 6,293,117 | B1 | 9/2001 | Ban et al. | |
| 6,299,423 | B1 | 10/2001 | Perevozchhikov | |
| 6,584,791 | B2 | 7/2003 | Monk et al. | |
| 6,705,094 | B2 * | 3/2004 | Alsenz | 62/116 |

FOREIGN PATENT DOCUMENTS

| | | |
|---|---|---|
| DE | 241 454 A1 | 12/1986 |
| EP | 0 743 456 A2 | 11/1996 |
| JP | 2001349627 | 12/2001 |
| WO | WO 94/21919 | 9/1994 |

* cited by examiner

PRESSURE EQUALIZATION SYSTEM

CROSS-REFERENCE TO RELATED APPLICATIONS

This Application is a continuation-in-part of application Ser. No. 10/194,501, filed Jul. 12, 2002 now U.S. Pat. No. 6,823,686, which is a continuation-in-part of application Ser. No. 09/826,106, filed Apr. 5, 2001, which issued as U.S. Pat. No. 6,584,791.

BACKGROUND OF THE INVENTION

The present invention relates generally to compressors, including those used in refrigeration and HVAC applications. More particularly, the present invention relates to a pressure equalization system and method for starting a compressor, such as a scroll, rotary, or reciprocating compressor, while maintaining the condenser at a high pressure.

A standard refrigeration or HVAC system includes a fluid, an evaporator, a compressor, a condenser, and an expansion valve. In a typical refrigeration cycle, the refrigerant fluid begins in a liquid state under low pressure. The evaporator evaporates the low pressure liquid as the liquid absorbs heat from the evaporator, which raises the ambient temperature of the liquid and causes the liquid to undergo a phase change to a low pressure gas. The compressor draws the gas in and compresses it, producing a high pressure gas. The compressor then passes the high pressure gas to the condenser. The condenser condenses the high pressure gas to release heat to the condenser and undergo a phase change to a high pressure liquid. The cycle is completed when the expansion valve expands the high pressure liquid, resulting in a low pressure liquid. By means of example only, the refrigerant fluid used in the system might be ammonia, ethyl chloride, CFCs, HFCs, Freon®, or other known refrigerants.

Typically, upon start up of a compressor, the pressure at both the suction port and the discharge port of the compressor is low. In operation, the compressor works the fluid to achieve a high pressure at the discharge port. However, when the compressor is no longer operating, the fluid on the high pressure side of the compressor (toward the condenser) flows back toward the low pressure side of the compressor (toward the evaporator) until a state of equilibrium between the formerly high and formerly low pressure sides is achieved. Thus, the pressure tends to equalize between the low pressure side and the high pressure side when the compressor stops operating. Such a system is inefficient because the refrigeration cycle requires energy at start up to create a high pressure in the condenser, which is needed to condense the fluid.

Another problem, specific to HVAC systems, is that it is difficult to efficiently achieve the high pressure start up, i.e. a start up where the pressures have not equalized, necessitated by seasonal energy efficiency requirements (SEER), a system used to rate HVAC systems. Start up components, such as a start capacitor and a start relay, are commonly used to overcome the differential pressure when the compressor needs to start with the unbalanced pressure in the system, i.e. the high pressure side of the system has a high pressure and the low pressure side of the system has a low pressure. These components achieve a high pressure differential start when the system is turned on. These components are rather expensive, however, and they produce high voltages and currents in the compressor motor upon start up.

Therefore what is needed is a system and method for equalizing the pressure in the compressor in order to start the compressor while maintaining a high pressure in the condenser and the high pressure portion of the system.

SUMMARY OF THE INVENTION

As explained in more detail below, the system and method of the present invention maintain a high pressure from a valve near the compressor discharge downstream to a condenser, but permit the pressure upstream of the valve to leak back toward the compressor suction until the pressure upstream of the valve has equalized with the low pressure side of the compressor. By maintaining the high pressure downstream from the valve and equalizing the pressure upstream from the valve, expensive and potentially dangerous start up components are eliminated. A benefit specific to HVAC systems is that the SEER rating of the system is not sacrificed.

The present invention is directed to a climate control system having a high pressure side and a low pressure side, wherein a fluid flowing through the climate control system changes state between a vapor state and a liquid state to provide climate control. The climate control system includes a compressor being operable to compress a fluid at a low pressure to a high pressure, the compressor comprising an inlet portion to receive fluid at a low pressure from a low pressure side of the system, a compression chamber for compression of fluid, and an outlet portion to provide fluid at a high pressure to a high pressure side of the system. A pressure equalization system is operatively connected to the compressor, the pressure equalization system being configured to equalize pressure between the inlet portion and the outlet portion of the compressor in response to the compressor not being in operation. The pressure equalization system includes a first inlet connection, the first inlet connection being in fluid communication with the outlet portion of the compressor. A check valve is configured and disposed downstream of the outlet portion and in fluid communication with the outlet portion. A first outlet connection is in fluid communication with the inlet portion of the compressor. A chamber is in fluid communication with the first inlet connection and the first outlet connection. A piston is slidably disposed within the chamber between a first position and a second position, wherein the piston prevents fluid flow between the first inlet connection and the first outlet connection through the chamber upon being in the first position and the piston permits fluid flow between the first inlet connection and the first outlet connection through the chamber upon being in the second position. A second inlet connection is configured and disposed to provide a passage for fluid between the compression chamber of the compressor and the chamber. The piston is positioned in the first position in the chamber in response to the compressor being in operation, and the piston being positioned in the second position in the chamber in response to the compressor not being in operation, the piston being movable between the first position and the second position by a fluid force differential between the first inlet connection and the second inlet connection, thereby permitting fluid at a high pressure to flow through the first inlet connection to the first outlet connection to equalize pressure in the compressor when the compressor is not operating.

The present invention is further directed to a climate control system having a high pressure side and a low pressure side, wherein a fluid flowing through the climate control system changes state between a vapor state and a liquid state to provide climate control. The climate control system includes a compressor being operable to compress a fluid at a low pressure to a high pressure, the compressor comprising an inlet portion to receive fluid at a low pressure from the low pressure side of the system and an outlet portion to provide fluid at a high pressure to the high pressure side of the system. A pressure equalization system is operatively connected to the compressor, the pressure equalization system being configured to equalize pressure between the inlet portion and the outlet portion of the compressor in response to a start-up operation of the compressor. The pressure equalization system includes a first inlet for fluid being in fluid communication with the outlet portion of the compressor. A first outlet for fluid is in fluid communication with the inlet portion of the compressor. A valve member is operably disposed with respect to the first inlet between a first position and a second position, wherein the first inlet and the first outlet are not in fluid communication upon the valve member being in the first position and the first inlet is in fluid communication with the first outlet upon the valve member being in the second position. A means is provided for moving the valve member with respect to the first inlet between the first position and the second position. The means for moving the valve member with respect to the first inlet positions the valve member in the second position in response to a start-up operation of the compressor, thereby permitting fluid at a high pressure to flow through the first outlet to the inlet portion of the compressor to equalize pressure in the compressor.

Another embodiment of the present invention is directed to a pressure equalization system for a compressor operable to compress a fluid at a first pressure to a second pressure greater than the first pressure. The system includes a discharge arrangement being configured and disposed to receive fluid at a second pressure from a compression device in the compressor. A check valve is disposed in the discharge arrangement and configured to permit fluid at the second pressure to flow through the check valve when the compressor is in operation and to prevent fluid at the second pressure from flowing through the check valve when the compressor is not in operation. A bleed system is disposed in the discharge arrangement upstream of the check valve and configured to provide a continuous flow of fluid from the discharge arrangement to a low pressure portion of the compressor at the first pressure. The bleed system includes a passageway of a predetermined size and predetermined length in fluid communication with the discharge arrangement. The passageway is sized to equalize pressure in the compressor between the low pressure portion of the compressor and the discharge arrangement upstream of the check valve when the compressor is not in operation, the passageway being sized not to impact compressor efficiency when the compressor is in operation.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The accompanying drawings, which are incorporated in and constitute a part of this specification, illustrate several embodiments of the invention. Together with the description, these drawings serve to explain the principles of the invention.

Wherever possible, the same reference numbers will be used throughout the drawings to refer to the same or like parts.

DETAILED DESCRIPTION OF THE INVENTION

A method and a system for equalizing the pressure in a compressor is provided to permit a startup of the compressor while maintaining a high pressure in portions of the system. It is contemplated that the compressor may be a component of a climate control system, including a refrigeration, freezer, or HVAC system. However, its use is not limited to such systems as the pressure equalization system may be used in any system utilizing a compressor.

Figure 1:
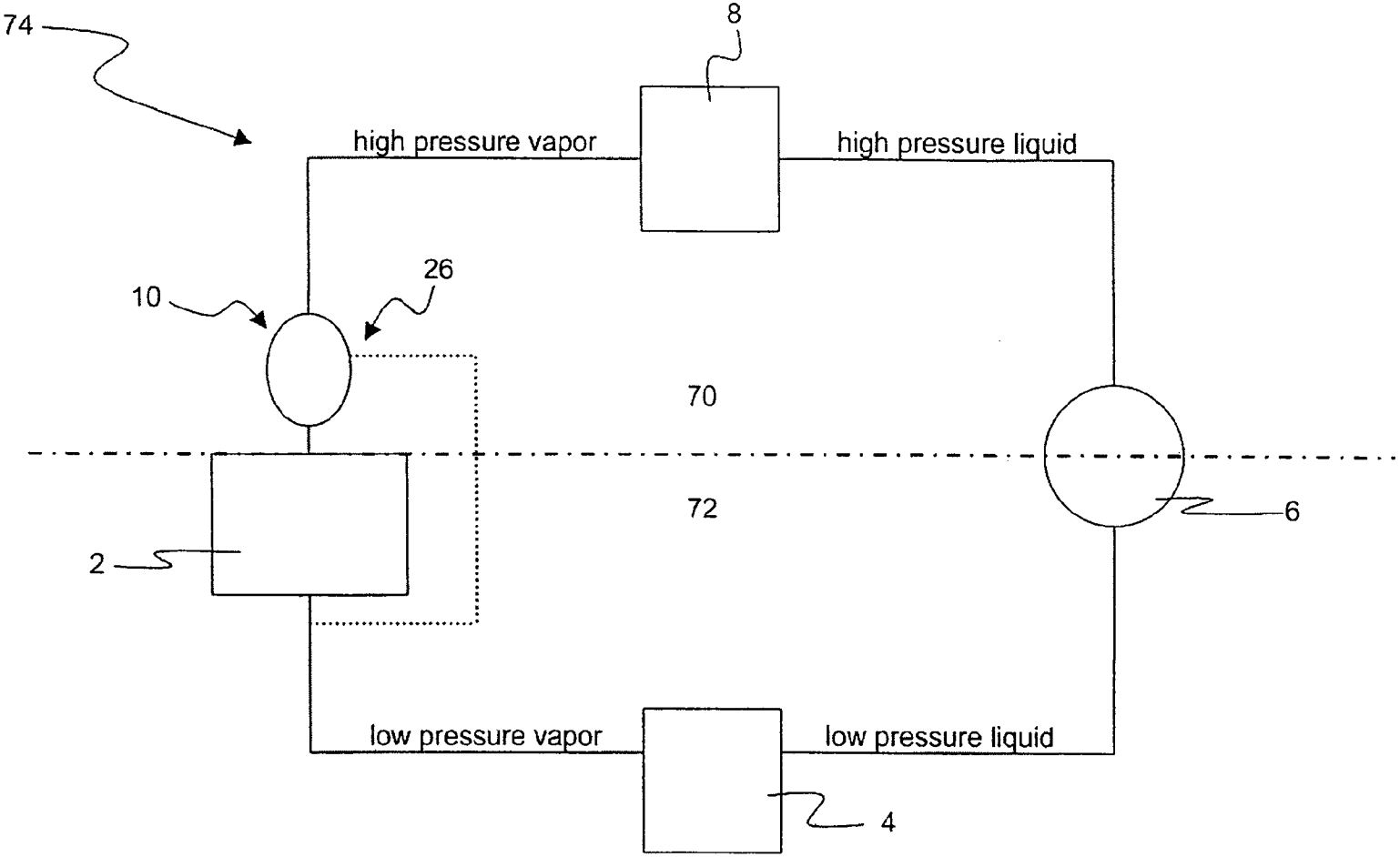
FIG. 1 is a block diagram of a climate control system schematically illustrating a pressure equalization system and method in accordance with the present invention.

An exemplary embodiment of a refrigeration system, including a compressor with a pressure equalization system according to the present invention, is illustrated in FIG. 1 and is designated generally as reference number 74.

In a refrigeration or HVAC system 74, typically a fluid or refrigerant flows through the system and heat is transferred from and to the fluid. When refrigeration system 74 is turned on, fluid in a liquid state under low pressure is evaporated in an evaporator 4 as the fluid absorbs heat from the evaporator, which raises the ambient temperature of the fluid and results in fluid in a low pressure vapor state. A compressor 2 draws away fluid at a low pressure vapor state and compresses it. Then, fluid at a high pressure vapor state flows to a condenser 8. Condenser 8 condenses the fluid from a high pressure vapor state to a high pressure liquid state. The cycle is completed when an expansion valve 6 expands the fluid from a high pressure liquid state to a low pressure liquid state. The fluid is any available refrigerant, such as, for example, ammonia, ethyl chloride, Freon®, chlorofluocarbons, hydrofluorocarbons, and natural refrigerants.

In conventional systems, when refrigeration system 74 stops operating, the fluid on the high side of compressor 2 at a high pressure vapor state will leak back toward the evaporator 4, and eventually the pressure of the fluid in the compressor 2 will reach a state of equilibrium. When the refrigeration system 74 is placed back into operation, the pressure at the condenser 8 must be brought back up to the pressures prior to refrigeration system 74 shutting down. In high efficiency systems, start capacitors and start relays are used to restart the compressor 2 and achieve this result when the pressures in the compressor are not equal on startup of the compressor. These components are expensive and produce high voltages and currents in the compressor 2 upon start up. Pressure equalization system 10 overcomes the need for such components in high efficiency systems and the problems and expenses associated with conventional systems, as described in more detail below.

Figure 2:
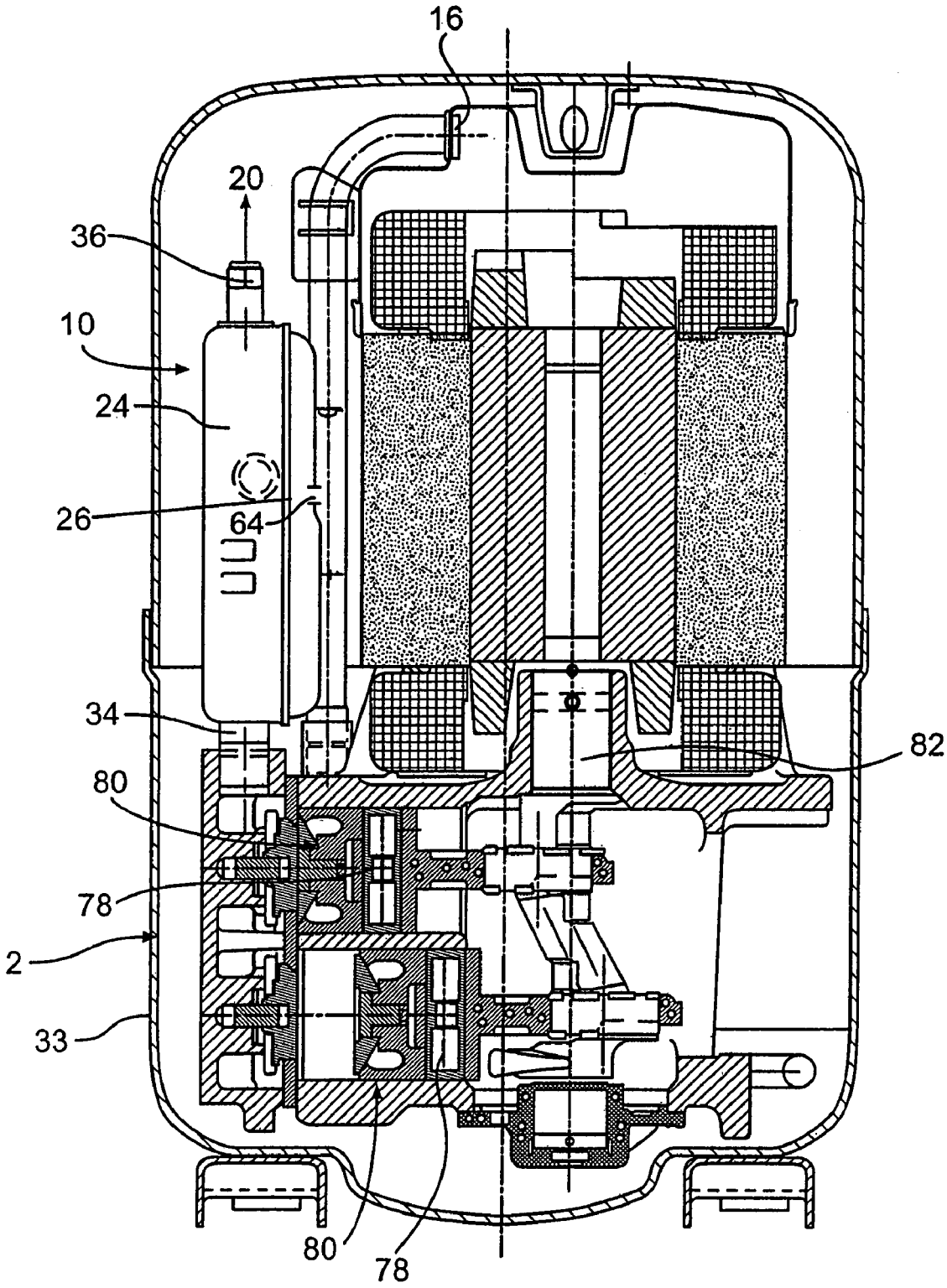
FIG. 2 is a cross-sectional view of a compressor including an internal pressure equalization system in accordance with an embodiment of the present invention.
Figure 3:
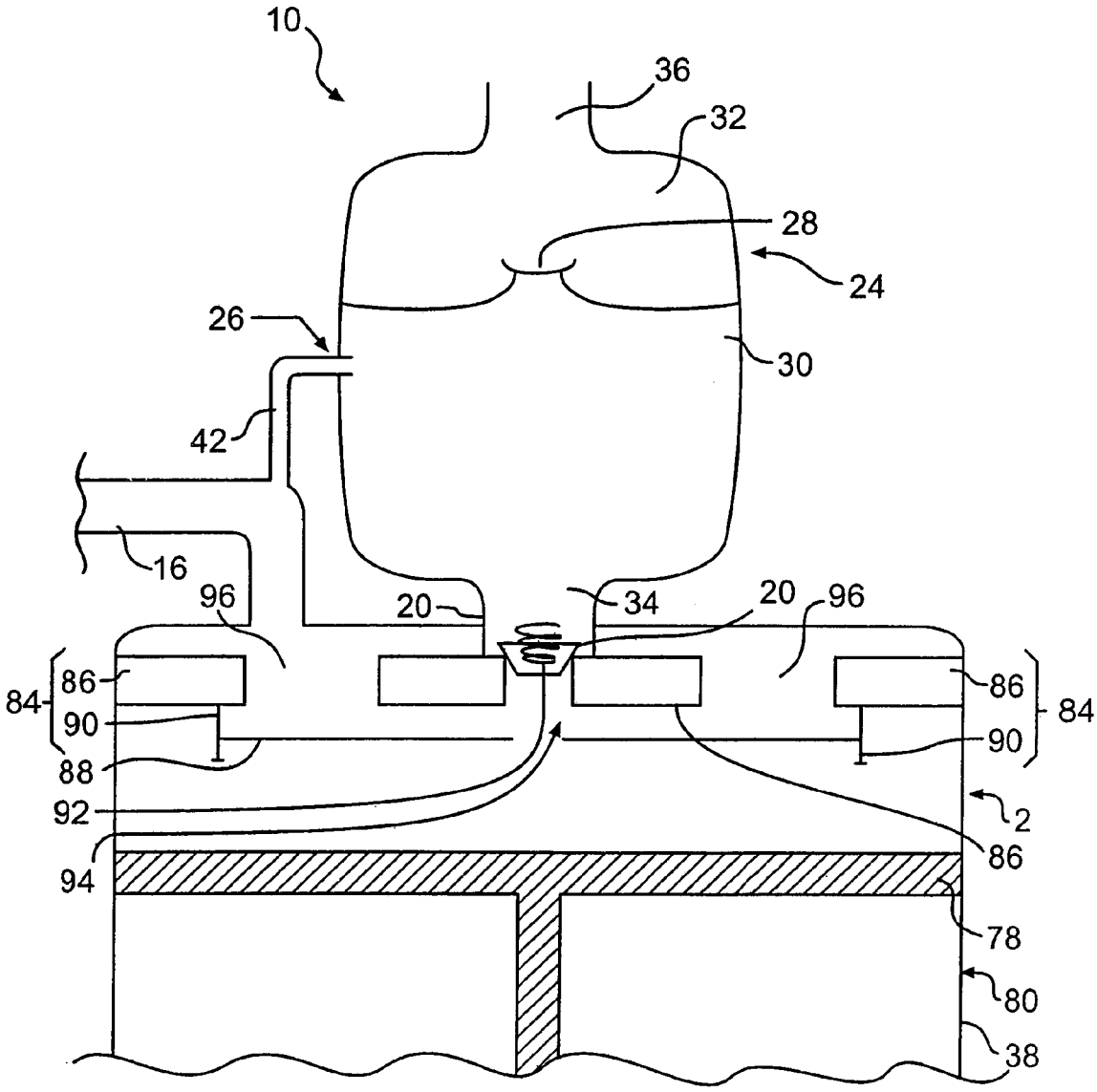
FIG. 3 is a cross-sectional view of a pressure equalization system attached externally to a compressor in accordance with another embodiment of the present invention.

The general components of a reciprocating compressor 2 are illustrated in FIGS. 2 and 3. The components may include compressor housing 38 that houses a shaft 82 that rotates and causes one or more pistons 78 to move within one or more compression chambers 80. The fluid, described above with respect to the schematic in FIG. 1, is drawn at a low pressure into a compressor inlet 16 (or suction line) and into compression chamber 80. For the purposes of the present invention, the compressor inlet 16 can be any point in the fluid flow channel extending from the evaporator 4 to the compression chambers 80. Piston 78 is operable to move within compression chamber 80 to compress the fluid, which exits compressor 2 at a high pressure through a compressor outlet 20 (or discharge). For the purposes of the present invention, the compressor outlet 20 can be any point in the fluid flow channel downstream from the compression chamber 80 to the condenser 8.

A compressor typically includes a valve system 84, such as the system exemplified in FIG. 3, to prevent the fluid from flowing back toward compressor inlet 16 when the compressor is operating. Such systems are known to those skilled in the art, and the system depicted in FIG. 3 is illustrative only and in no way limits the claimed invention. The illustrated valve system 84 includes a valve plate 86 disposed within compressor housing 38, a valve 92 operably disposed at the compressor outlet 20, and a ring valve 88, defining an aperture 94, slidably disposed on holders 90. Retraction of piston 78 creates a vacuum that draws ring valve 88 away from gaps 96, and draws the fluid into compression chamber 80 through compressor inlet 16. A valve 92 on compressor outlet 20 prevents the fluid from exiting compressor 2 until the fluid reaches a pressure exceeding that beyond valve 92. When piston 78 moves and compresses the fluid to this pressure, the force of the fluid opens valve 92, thereby permitting the high pressure fluid to discharge through compressor outlet 20. During the compression stroke, the force of the fluid moves ring valve 88 towards valve plate 86, blocking gaps 96 and preventing the fluid from escaping through compressor inlet 16.

In accordance with the present invention, a pressure equalization system and method is provided to equalize the pressure in the compressor 2, permitting the compressor 2 to start under non-high pressure loading, while maintaining a high pressure in the high pressure portion of the refrigeration system 74. In one embodiment, the pressure equalization system is connected to the compressor 2 and has a valve or a series of valves and a bleed port. The valve or valves maintain high pressure on the high pressure portion of the refrigeration system 74, i.e. the valve(s) maintains a high pressure downstream from the valve to the condenser 8 and the expansion valve 6, when the refrigeration system 74 stops operating. The bleed port permits the pressure in the compressor 2 to reach a state of equilibrium between the high pressure side and the low side of the compressor 2 when the refrigeration system 74 is turned off. The bleed port can be configured to permit little to no fluid to pass through when the system 74 is operating but to permit fluid to leak through when the system is turned off. The pressure equalization system maintains fluid at a high pressure vapor state on the high pressure portion of the refrigeration system 74 while permitting fluid in the compressor 2 to reach a state of equilibrium when the compressor 2 and refrigeration system 74 are turned off. Upon restarting the compressor 2 and refrigeration system 74, it is therefore easier and more efficient to achieve the high pressure state in the high pressure portion of the system 74 because most of the high pressure portion of the system 74 has maintained a high pressure state and has not equalized with the low pressure portion of the system.

Exemplary embodiments of a compressor with a pressure equalization system are illustrated in FIGS. 2 and 3. It is contemplated that pressure equalization system 10 may be located internally within compressor 2, as shown in FIG. 2, or externally as shown in FIGS. 1 and 3. The compressor 2 shown in FIG. 2 is a reciprocating compressor, although the pressure equalization system 10 may be used with any compressor, including, for example, a rotary, screw, or scroll compressor.

As illustrated in FIGS. 2 and 3, compressor outlet 20 is in communication with a housing 24 of pressure equalization system 10, which has a housing inlet 34 and a housing outlet 36. In FIG. 2, housing 24 is located internally within compressor 2, and housing outlet 36 connects to compressor outlet 20. The present invention contemplates, however, that housing 24 in FIG. 3 may be positioned externally to compressor 2, such that housing inlet 34 connects to compressor outlet 20. Among other variations, it also has been contemplated that housing inlet 34 could be connected to a cylinder head and housing outlet 36 could be connected to compressor outlet 20.

In the embodiments shown in FIGS. 2 and 3, housing 24 is a container or a muffler. Housing 24 also could be a cylinder or any other closed chamber, as described in more detail with respect to FIGS. 8-10. Whether housing 24 is internal or external to compressor 2, the pressure equalization system 10 maintains the fluid at a high pressure vapor state on the high pressure side towards housing outlet 36 while permitting the fluid towards compressor inlet 16 to equalize with the fluid at a low pressure vapor state.

Various embodiments of pressure equalization system 10 are depicted in FIGS. 4-10. In each of these embodiments, it is assumed that housing 24 is in communication with compressor 2 as previously described.

Figure 4:
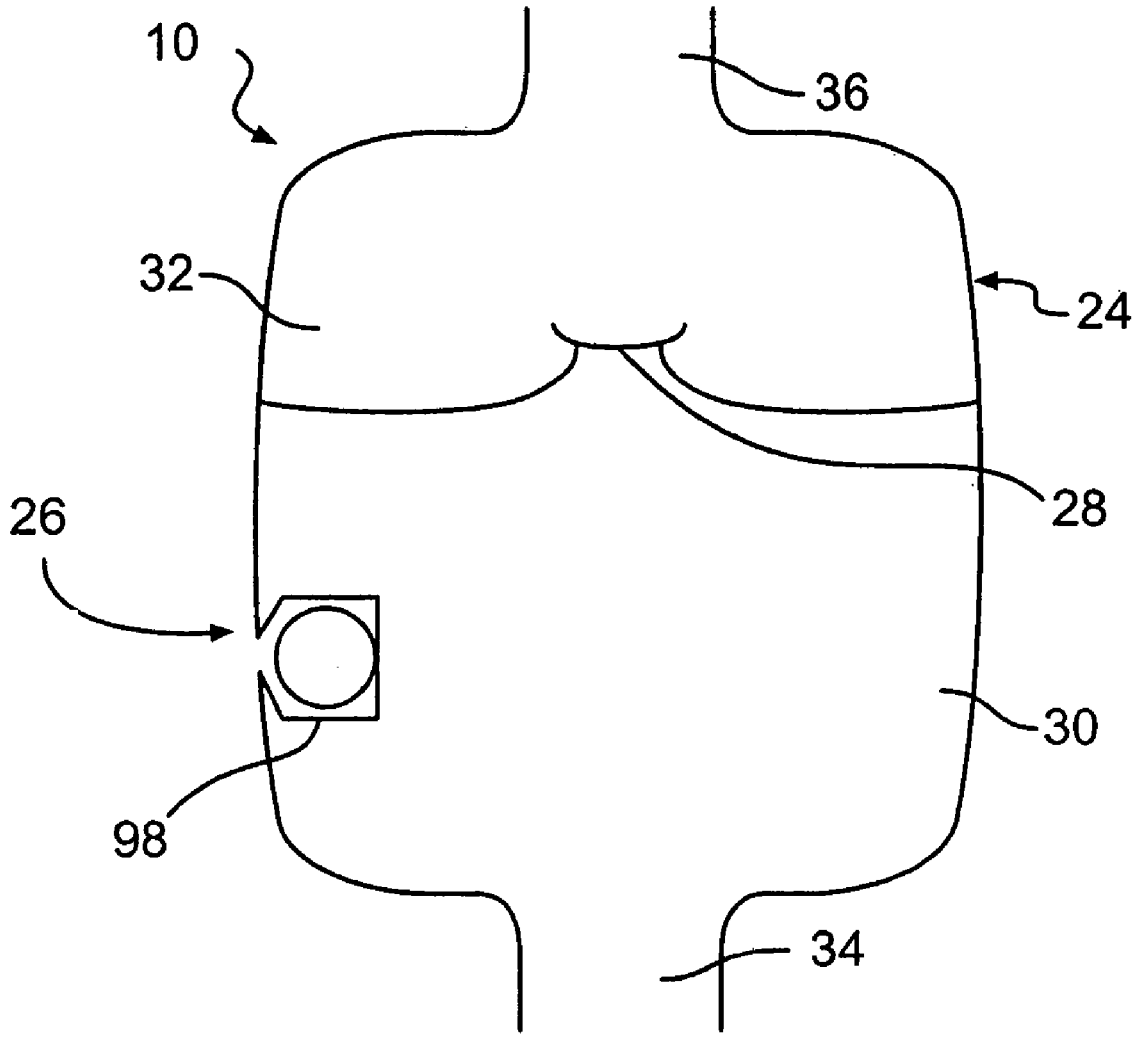
FIG. 4 is a cross-sectional view of a pressure equalization system, including a housing, two valves, and a bleed port, in accordance with an embodiment of the present invention.

In a basic embodiment of pressure equalization system 10, shown in FIG. 4, housing 24 has a bleed port 26 and at least one valve 28. Valve 28 divides housing 24 into a first portion 30 and a second portion 32. First portion 30 of housing 24 occupies a space between housing inlet 34 and valve 28, while second portion 32 of housing 24 occupies a space between valve 28 and housing outlet 36. Valve 28 is operably disposed in housing 24 and may be opened or closed. When compressor 2 is on, valve 28 is open and permits the fluid compressed at a high pressure vapor state to flow from first portion 30 of housing 24 to second portion 32 of housing 34. When compressor 2 stops operating, valve 28 closes, preventing backflow of the fluid at a high pressure vapor state into first portion of housing 24. Bleed port 26, located in first portion 30 of housing 24, connects first portion 30 of housing 24 to low pressure side 72 of compressor 2, such as to compressor inlet 16, permitting the pressure of the fluid, which is at a high pressure vapor state when the compressor 2 initially is turned off, to equilibrate with the fluid on the low side of compressor 2, which is at a low pressure vapor state. Bleed port 26 is connected to a low pressure side of compressor 2 in a sealed manner, for example, through a pipe, tube, or other flow channel, so that the fluid stays within the system 74 and does not leak into the atmosphere.

Figure 11:
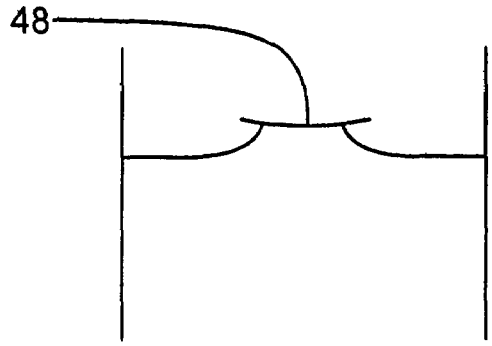
FIG. 11 is a cross sectional view of a magnetic check valve in accordance with an embodiment of the present invention.
Figure 12:
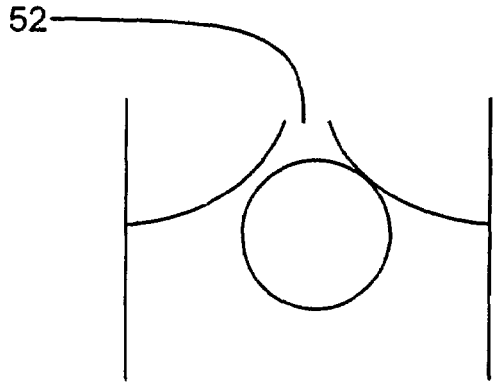
FIG. 12 is a cross sectional view of a ball check valve in accordance with another embodiment of the present invention.
Figure 13:
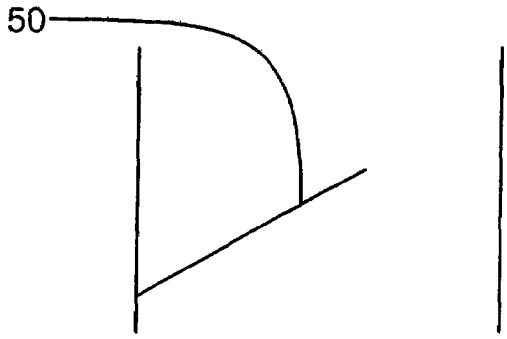
FIG. 13 is a cross sectional view of a flapper check valve in accordance with another embodiment of the present invention.

It is contemplated that valve 28 of pressure equalization system 10 may be one or more of a variety of valve types. Some typical valves are illustrated in FIGS. 11-13. One embodiment, illustrated in FIG. 11, is a magnetic check valve 48. Another embodiment, illustrated in FIG. 12, is a ball check valve 52. Yet another embodiment, illustrated in FIG. 13, is a flapper check valve 50. Any type of one-way valve, including but not limited to these valves, can be applied to the present invention.

Figure 8:
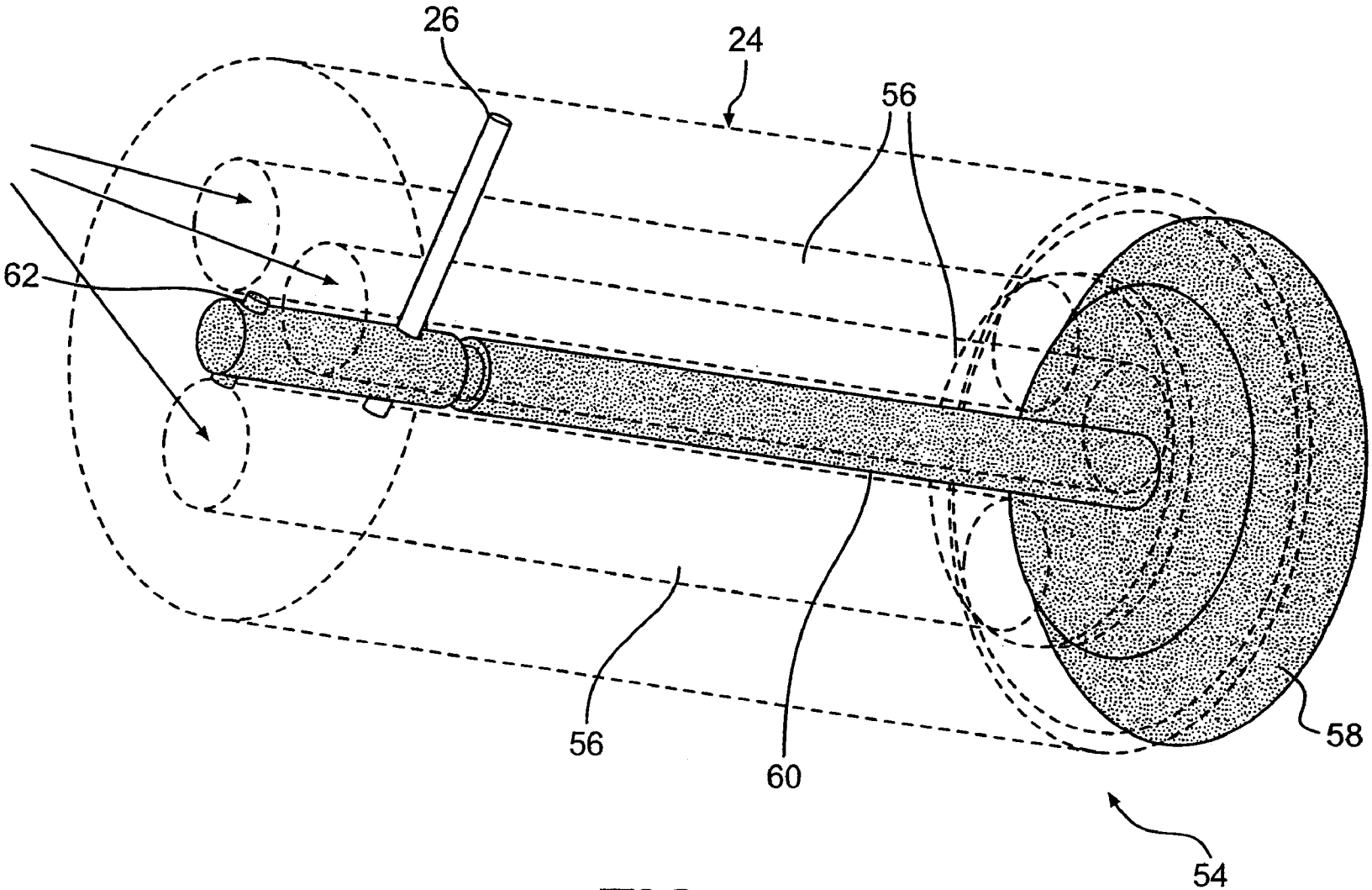
FIG. 8 is a perspective view of a cylinder valve in accordance with an embodiment of the present invention.
Figure 9:
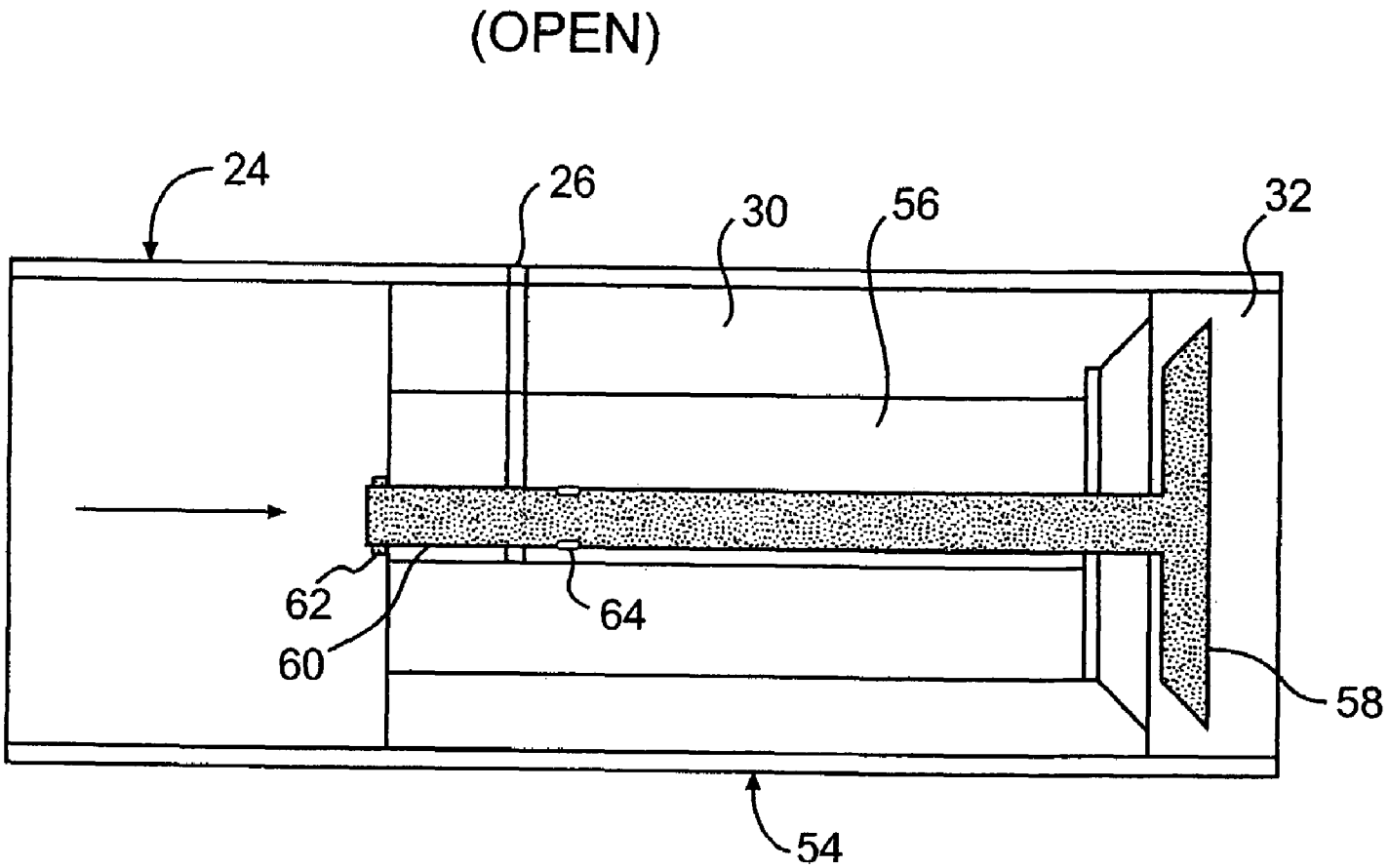
FIG. 9 is a section through the piece of the cylinder valve depicted in FIG. 8 in an open position.
Figure 10:
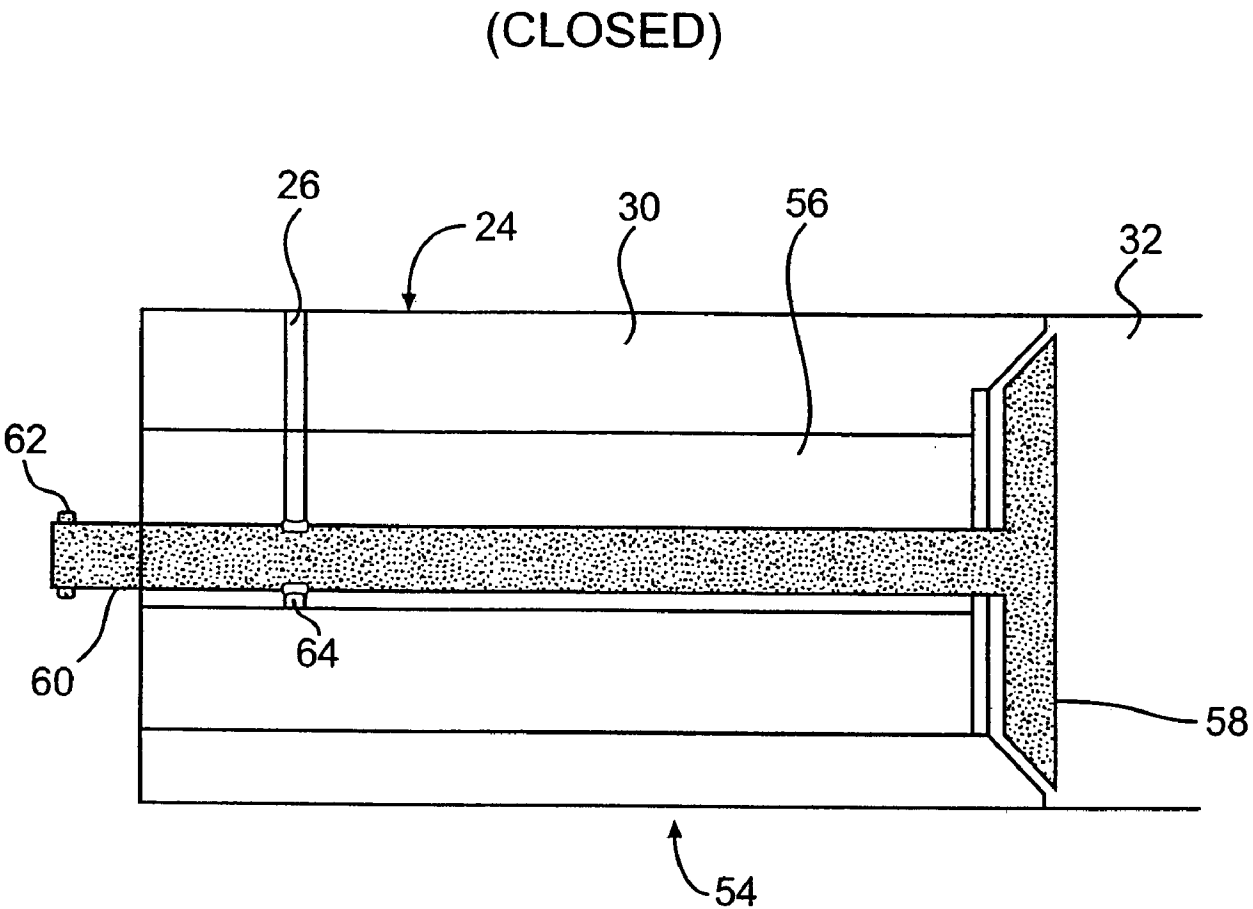
FIG. 10 is a section through the piece of the cylinder valve depicted in FIG. 8 in a closed position.

In an embodiment illustrated in FIGS. 8-10, pressure equalization system 10 comprises housing 24 having a cylinder check valve 54, and preferably bleed port 26 is of an aperture 64 type. In such an embodiment, housing 24 defines a cylinder that includes a plurality of channels 56 for conducting the fluid. It is contemplated, however, that cylindrical housing 24 may have as few as one channel 56. First portion 30 of cylindrical housing 24 is substantially solid aside from channels 56, while second portion 32 of cylindrical housing 24 is open. Valve 54 disposed within cylindrical housing 24 has a valve stem 60 attached to an end portion such as a poppet 58.

Poppet 58 is located in second portion 32 of housing 24. It is contemplated that poppet 58 has a cross-sectional area equal to the internal area of cylindrical housing 24, although any configuration of housing 24 and poppet 58 that prohibits the fluid from leaking from first portion 30 of housing 24, through valve 54, to housing outlet 36, is acceptable.

Meanwhile, valve stem 60 extends from poppet 58 through first portion 30 of housing 24 and towards inlet 34 of housing 24. Valve stem 60 may have an overtravel stopper 62 beyond inlet 34 of housing 24 that comes in contact with the substantially solid first portion 30 of housing 24 when compressor 2 is operating. Although overtravel stopper 62 is shown in the embodiment illustrated in FIGS. 8-10, any device that prevents poppet 58 and valve stem 60 from being pushed through housing 24 by the fluid is acceptable.

When compressor 2 is operating, the fluid at a high pressure vapor state travels into inlet 34 (not shown in FIGS. 8-10) of housing 24 and into channels 56, forcing cylinder valve 54 to open. As shown in FIG. 9, because the fluid forces poppet 58 into second portion 32 of housing 24, the fluid passes through the opening created when poppet 58 is forced open and toward housing outlet 36. Overtravel stopper 62 prevents poppet 58 and valve stem 60 from being forced too far into or beyond second portion 32 of housing 24. As shown in FIG. 10, when compressor 2 stops operating, the fluid stops flowing into housing inlet 34 and into channels 56, and as a result poppet 58 is no longer forced open by the fluid. Poppet 58 therefore closes, preventing the fluid contained in second portion 32 of housing 24 from flowing back towards housing inlet 34. The fluid in the second portion 32 of housing 24 on high pressure side 70 of compressor 2 therefore remains at a high pressure vapor state, thus high pressure side 70 of refrigeration system 74 remains high.

A bleed port 26 is provided to equalize pressure for startup of a compressor 2. In an embodiment shown in FIGS. 8-10, when compressor 2 stops operating, the high pressure vapor state fluid in channels 56 in first portion 30 of housing 24 is permitted to equalize with the fluid at a low pressure vapor state, thus the first portion 30 of housing 24 on the high pressure side 70 of compressor 2 is at a lower pressure, resulting in the aforementioned benefits upon restarting compressor 2. The equilibration in this preferred embodiment is due to bleed port 26, as shown in FIGS. 8-10 and described more fully below.

It is also contemplated that bleed port 26 of pressure equalization system 10 includes a variety of forms, provided bleed port 26 permits the fluid contained in first portion 30 of housing 24 at a high pressure vapor state to equalize with the fluid at a low pressure vapor state on low pressure side 72 of compressor 2. Additionally, bleed port 26 can be configured so that little to no fluid leaks through to low pressure side 72 of compressor 2 when the refrigeration system 74 is operating but permits fluid to leak through to low pressure side 72 of compressor 2 when the refrigeration system 74 is shut down.

For example, bleed port 26 may be a simple aperture or hole in first portion 30 of housing 24. As illustrated in FIG. 2, when housing 24 is located internally within compressor 2, bleed port 26 may be a hole or aperture 64 between housing 24 and compressor inlet 16. In this embodiment, bleed port 26 is small enough to prevent a significant amount of fluid from flowing back to compressor inlet 16 when the compressor is operating, but large enough to permit the pressure of the fluid to reach a state of equilibrium with low pressure side 72 of compressor 2 over a period of time when the compressor stops operating.

Meanwhile, when housing 24 is external to compressor 2, as shown in FIG. 3, a connector 42, such as a capillary or other tube or hypodermic needle, connects first portion 30 of housing 24 to low pressure side 72 of compressor 2, such as to compressor inlet 16, in order to equalize fluid pressure. Again, bleed port 26, including aperture 64 leading to connector 42, is small enough to prevent a significant amount of fluid from flowing back to compressor inlet 16 when the compressor is operating, but large enough to permit the pressure of the fluid to reach a state of equilibrium with low pressure side 72 of compressor 2 over a period of time when the compressor stops operating.

Figure 6:
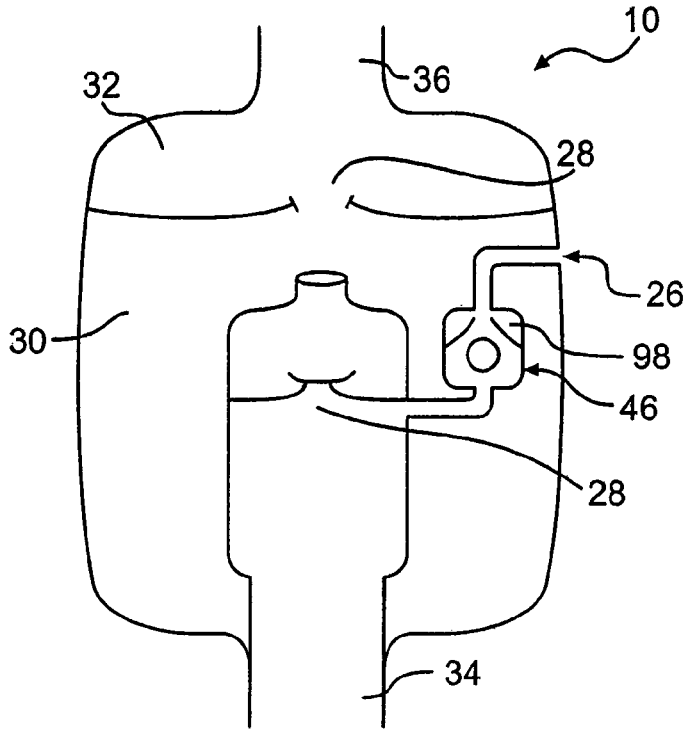
FIG. 6 is a cross-sectional view of a pressure equalization system, including a housing, several valves, and an internal subhousing with a bleed port, in accordance with another embodiment of the present invention.
Figure 7:
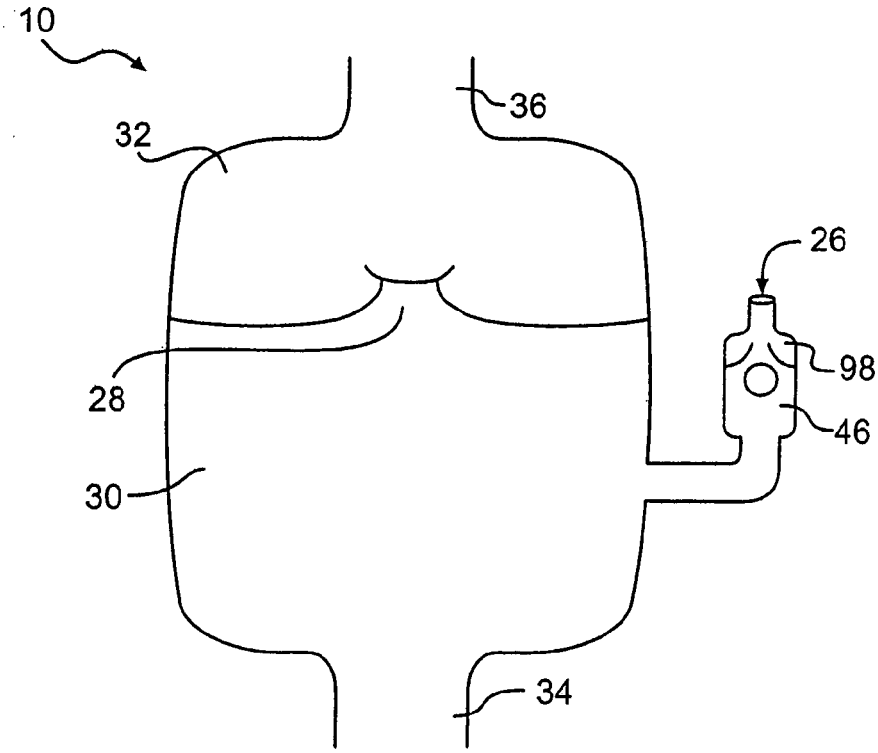
FIG. 7 is a cross-sectional view of a pressure equalization system, including a housing, two valves, and an external subhousing with a bleed port, in accordance with another embodiment of the present invention.

Additionally, as illustrated in FIGS. 4, 6, and 7, bleed port 26 may be a valve 98 of any type described above with respect to valve 28, including but not limited to magnetic check valve 48, flapper check valve 50, ball check valve 52, or a combination of any such valve and connector 42. The tolerance of valve 98 permits valve 98 to open under a lower fluid pressure, letting the fluid leak through valve 98 when compressor 2 stops operating to achieve a state of equilibrium with low pressure side 72 of compressor 2, but the tolerance permits valve 98 to close under a higher fluid pressure, preventing fluid from passing through valve 98 when compressor 2 is operating. Valve 98 therefore has a tolerance over a range of pounds per square inch that meets this requirement for the particular refrigeration or HVAC system 74. In one embodiment of the present invention, the valve in bleed port 26 can be a solenoid valve that is closed when the compressor 2 is in operation and open when the compressor 2 is not in operation.

Figure 14:
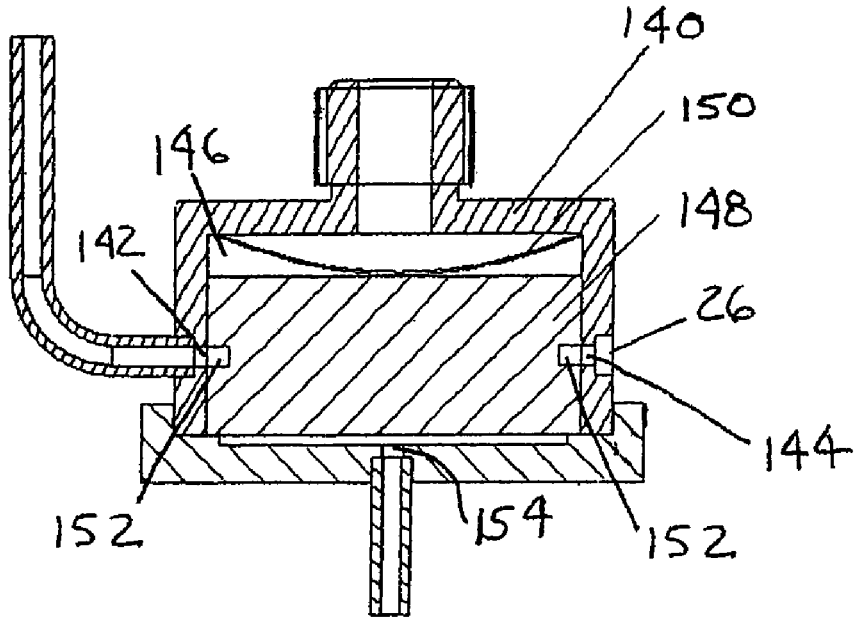
FIGS. 14 and 15 are cross-sectional views of a relief valve for a bleed port in an open position and a closed position, respectively, in one embodiment of the present invention.
Figure 15:
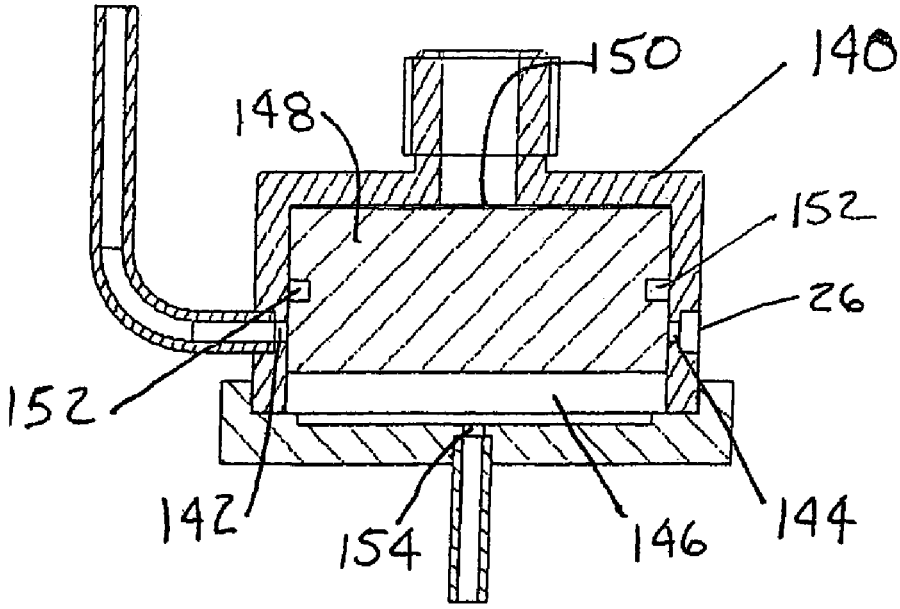

In another embodiment of the present invention, the bleed port 26 can include a relief valve 140 that can be opened and closed independently of the pressure in the first portion 30 of the housing 24. FIGS. 14 and 15 illustrate an embodiment of the present invention that includes the relief valve 140 as part of bleed port 26 that can be opened and closed independently of the pressure in the first portion 30 of the housing 24 (not shown in FIGS. 14 and 15). FIG. 14 illustrates the relief valve 140 of bleed port 26 in the open position and FIG. 15 illustrates the relief valve 140 of bleed port 26 in the closed position.

Similar to the bleed port valves described in greater detail above, the relief valve 140 is opened when the compressor 2 is not in operation to permit fluid at a high pressure vapor state in the first portion 30 of housing 24 to leak back to the low pressure side 72 of compressor 2 in order to equalize the pressures between the high pressure side 70 and the low pressure side 72 in the compressor 2. The relief valve 140 is then closed during operation of the compressor 2 to prevent or limit fluid in the first portion 30 of housing 24 from leaking back to the low pressure side 72 of compressor 2. The bleed port 26 and relief valve 140 shown in FIGS. 14 and 15 can be located either internal or external to housing 24.

Relief valve 140 has an inlet 142 in fluid communication with the first portion 30 of housing 24 and an outlet 144 in fluid communication with the bleed port 26 and the low pressure side 72 of compressor 2. Between the inlet 142 and the outlet 144 of the relief valve 140 is a chamber 146 in fluid communication with both the inlet 142 and the outlet 144. A piston 148 is slidably disposed in the chamber 146 and controls the opening and closing of the relief valve 140.

To open relief valve 140 when the compressor is not in operation, the piston 148 is urged into a first position in chamber 146 by biasing mechanism 150. Biasing mechanism 150 is disposed in contact with the piston 148 and is configured and used to urge the piston 148 to the first position in the chamber 146. The biasing mechanism 150 is preferably a spring and more preferably a leaf spring, however, any mechanism that can urge the piston 148 into the first position in the chamber 146 when the compressor 2 is not in operation can be used. In another embodiment of the present invention, instead of a mechanism to urge the piston 148 into the first position in the chamber 146, the relief valve 140 and chamber 146 can be oriented and positioned to permit gravity to move the piston 148 into the first position in the chamber 146 when the compressor 2 is not in operation.

FIG. 14 illustrates the relief valve 140 in the open position and piston 148 in the first position in the chamber 146. To permit the flow or leakage of fluid from the inlet 142 to the outlet 144, the piston 148 has a groove or channel 152 that is in fluid communication with both the inlet 142 and the outlet 144 only when the piston 148 is in the first position in the chamber 146. In a preferred embodiment of the present invention, the groove or channel 152 is disposed about the circumference or perimeter of the piston 148. However, the groove or channel 152 can also be disposed through the body of the piston 148 or disposed in any other manner that permits fluid communication between the inlet 142 and the outlet 144 only when the piston 148 is in the first position.

To close the relief valve 140 during the operation of the compressor 2, the piston 148 is urged into a second position in the chamber 146 by the operation of the compressor 2. The relief valve 140 is configured to permit an operating feature of the compressor 2 be used to apply the force that urges the piston 148 into the second position. In a preferred embodiment of the present invention, the operating feature used to urge the piston 148 into the second position is the oil pressure in the compressor 2 and more preferably the bearing oil pressure. In another embodiment, the oil pressure can be obtained from the high pressure side of the compressor 2. However, it is to be understood that any operating feature of the compressor 2 (e.g. centrifugal forces from rotating parts of the compressor 2, such as shaft 82, magnetic forces or effects from parts of the compressor 2, such as a motor stator, or flow of compressed gas) can be used to urge the piston 148 into the second position.

FIG. 15 illustrates the relief valve 140 in the closed position and piston 148 in the second position in the chamber 146. The positioning of the piston 148 in the second position in the chamber 146 prevents the flow of fluid between the inlet 142 and the outlet 144 of the relief valve 140 because the channel 152 is no longer aligned with the inlet 142 and the outlet 144 and the body of piston 148 blocks the inlet 142 and the outlet 144 preventing any fluid from flowing through the chamber 146. To urge the piston 148 into the second position, there is an opening or inlet 154 in chamber 146 that is in fluid communication with, for example, the bearing oil of the compressor 2. When the compressor 2 is operating, the pressure of the bearing oil in the compressor 2 increases, causing the bearing oil in the compressor 2 to enter the chamber 146 through opening 154 and urge the piston 148 into the second position. The pressure of the bearing oil in the chamber 146 is sufficient to overcome the bias or tension of the biasing mechanism 150 and urge the piston into the second position. When the compressor 2 stops operating, the pressure of the oil in chamber 146 decreases as oil drains from the chamber 146 and the bias of the biasing mechanism 150 urges the piston 148 into the first position to open relief valve 140, thereby permitting the equalization of the pressure in the compressor 2.

In one preferred embodiment of pressure equalization system 10, bleed port 26 is designed so that it will permit the fluid to bleed from high pressure side 70 to low pressure side 72 only when compressor 2 is not operating. One embodiment of such a system is illustrated in FIGS. 8-10. In this embodiment, a cylinder valve 54 is formed by housing 24, poppet 58, and valve stem 60. As shown in FIGS. 8-10, depicting cylinder valve 54, valve stem 60 has an aperture 64. First portion 30 of housing 24, which is substantially solid aside from channels 56, has bleed port 26 connecting all channels 56. There may be one or more such channels 56. It is contemplated that bleed port 26 is in communication with low pressure side 72 of compressor 2, as previously discussed with respect to apertures and connectors such as tubes in embodiments shown in FIGS. 2 and 3.

In the preferred embodiment, pressure equalization system 10 is highly efficient because bleed port 26 permits equilibration of the fluid in first portion 30 of housing 24 with low pressure side 72 of compressor 2 when compressor 2 stops operating but prevents any of the fluid from leaking from first portion 30 of housing 24 when compressor 2 is operating. When compressor 2 is operating, the fluid forces poppet 58 open, which is connected to valve stem 60. Thus, aperture 64 in valve stem 60 misaligns with bleed port 26, thereby preventing any of the fluid at a high pressure vapor state from leaking from channels 56 out of bleed port 26. This. "open" position is shown in FIG. 9. When compressor 2 stops operating, poppet 58 closes and aperture 64 on valve stem 60 aligns with bleed port 26, as shown in FIG. 10. Because poppet 58 closes, the fluid at a high pressure vapor state in second portion 32 of housing 24 is held at high pressure, as previously described. Meanwhile, due to the configuration of the valve stem 60, aperture 64 and bleed port 26 shown in FIG. 10, the fluid at a high pressure vapor state is permitted to leak from channels 56 in first portion 30 of housing 24, though aperture 64, into bleed port 26. Equilibration of the fluid in first portion 30 of housing 24 therefore is achieved via bleed port 26 in pressure equalization system 10, as previously described with respect to FIGS. 2 and 3.

The embodiments shown in FIGS. 1-10 are only representative of additional potential configurations of pressure equalization systems 10 and in no way are intended to limit the present invention.

Figure 5A:
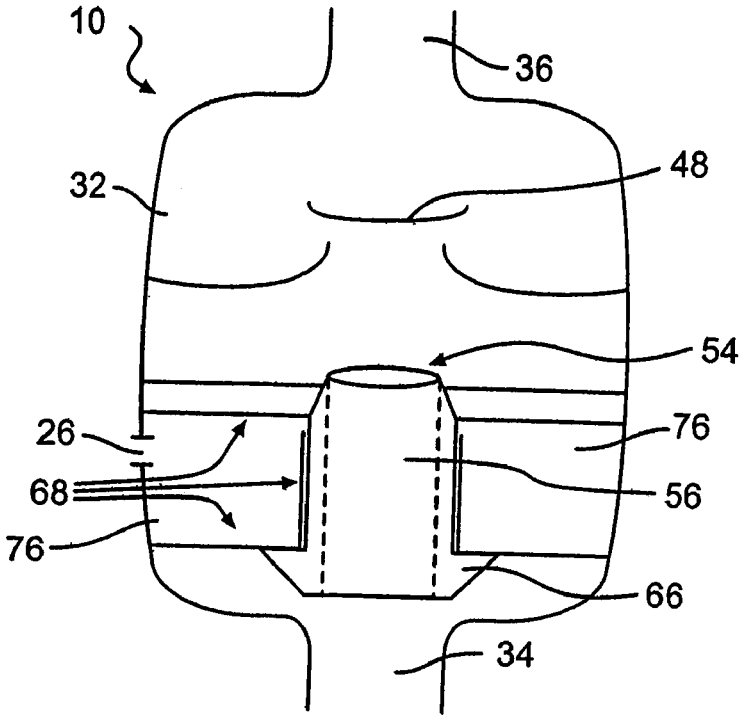
FIGS. 5*a* and 5*b* are cross-sectional views of a pressure equalization system, including a housing, two valves, and a bleed port in a closed position and an open position, respectively, in one embodiment of the present invention.
Figure 5B:
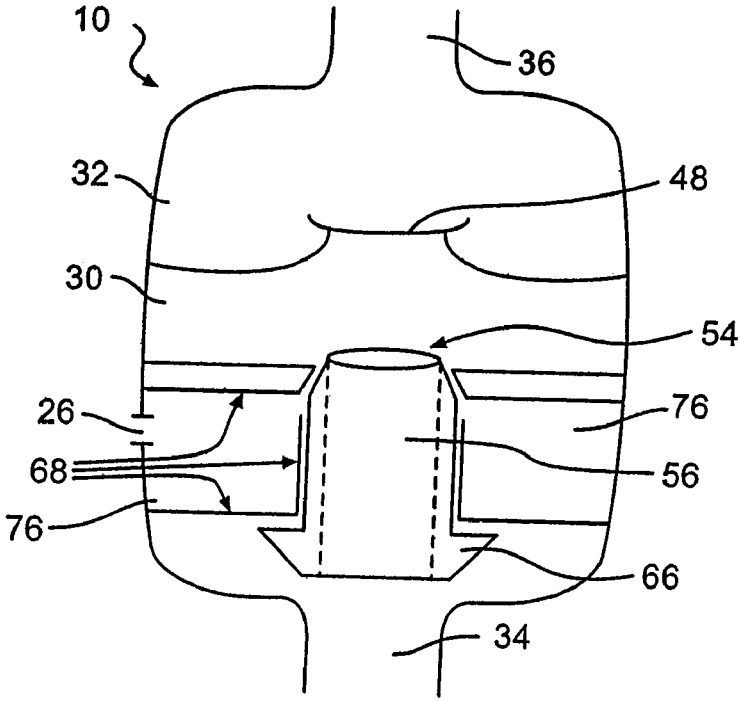

FIGS. 5*a* and 5*b* illustrate an embodiment of pressure equalization system 10 internal or external to compressor 2. Housing 24 contains a valve, such as a magnetic check valve 48, separating first portion 30 of housing 24 from second portion 32. First portion 30 further contains a second valve, such as a cylinder-type check valve 54, operably disposed in a check valve guide 68. Cylinder check valve guide 68 defines low pressure chambers 76 on either side. Cylinder check valve 54 has a lip 66 on the end facing inlet 34 of housing 24 to prevent cylinder check valve 54 from passing through check valve guide 68 when compressor 2 is operating. Cylinder check valve 54 also has a channel 56 through which the fluid passes towards outlet 36 of housing 24 when compressor 2 is operating. Bleed port 26 is an aperture located in housing 24 in an area encompassed by low pressure chamber 76. Pressure equalization system 10, as shown in FIGS. 5*a* and 5*b*, therefore maintains the fluid at a high pressure vapor state in second portion 32 of housing 24 while permitting the fluid in first portion 30 of housing 24 to equilibrate with the fluid at a low pressure vapor state.

As shown in FIG. 5*a*, when compressor 2 is operating, the fluid flows at a high pressure state into first portion 30 of housing 24, through first channel 56 of cylinder check valve 54, and through magnetic check valve 48 into second portion 32 of housing 24. Because of the fluid pressure, cylinder check valve 54 abuts cylinder check valve guide 68, closing bleed port 26. When compressor 2 stops operating, as shown in FIG. 5*b*, magnetic check valve 48 closes and the fluid remains at a high pressure vapor state in second portion 32 of housing 24. The fluid in first portion 30 of housing 24 is also at a high pressure vapor state but begins to leak into low pressure chambers 76 and through bleed port 26. When compressor 2 stops operating, the fluid pressure against the bottom of cylinder check valve 54 decreases and cylinder check valve 54 no longer abuts against the cylinder check valve guide 68.

FIGS. 6 and 7 illustrate embodiments of the present invention where bleed port 26 is a subhousing 46 housing a valve 98. In FIG. 6, subhousing 46 for valve 98 is located internally within first portion 30 of housing 24, while in FIG. 7 subhousing 46 for valve 98 is external to, but in communication with, first portion 30 of housing 24. The pressure equalization systems depicted in FIGS. 6 and 7 generally operate in the same manner as those previously described.

Figure 16:
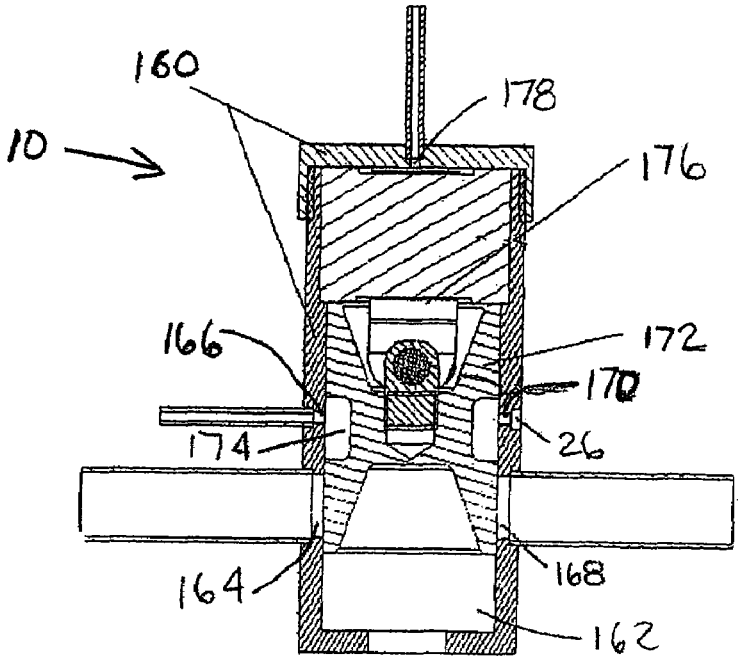
FIGS. 16 and 17 illustrate an alternate embodiment of the pressure equalization system of the present invention.
Figure 17:
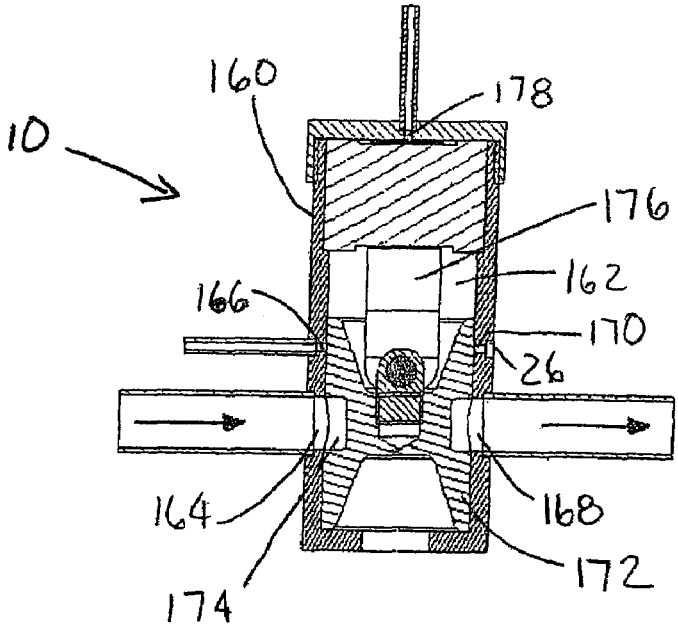

FIGS. 16 and 17 illustrate an alternate embodiment of the pressure equalization system 10, which uses a single device to control both discharge flow of high pressure fluid from the compressor 2, when the compressor 2 is in operation, and relief flow of high pressure fluid to equalize the pressure in the compressor 2, when the compressor 2 is not in operation. FIG. 16 illustrates the pressure equalization system 10 when the compressor 2 is not in operation and FIG. 17 illustrates the pressure equalization system 10 when the compressor 2 is in operation.

The pressure equalization system 10 includes a housing 160 having an internal chamber 162. The housing 160 has an inlet or opening 164 for discharge flow of high pressure fluid into the chamber 162 and an inlet or opening 166 for relief flow of high pressure fluid into the chamber 162. The discharge inlet 164 and the relief inlet 166 are in fluid communication with the compressor 2 to receive high pressure fluid from the compressor 2. The high pressure fluid entering the discharge inlet 164 and the relief inlet 166 can flow directly from the outlet 20 of the compressor 2 or the cylinder head of the compressor 2 in a direct piping connection or the high pressure fluid can enter the discharge inlet 164 and the relief inlet 166 after flowing through one or more intermediate chambers or containers, e.g. first portion 30 of housing 24. The housing 160 also includes a discharge outlet 168 and a relief outlet 170 for the exiting of high pressure fluid from the chamber 162. The discharge outlet 168 is in fluid communication with the condenser 8 permitting the high pressure fluid to flow to the condenser 8 as described above. The relief outlet 170 is in fluid communication with bleed port 26 permitting the high pressure fluid to return the low pressure side 72 of compressor 2 to equalize pressure in the compressor 2 when the compressor 2 is not in operation.

A piston 172 is slidably disposed within chamber 162 and operates as a discharge valve between discharge inlet 164 and discharge outlet 168 and as a relief valve between relief inlet 166 and relief outlet 170. When the compressor 2 is in operation, the piston 172 is positioned in a first position, as shown in FIG. 17, which results in the discharge valve being open to permit high pressure fluid to flow to the condenser 8 and results in the relief valve being closed to prevent flow of high pressure fluid back to the low pressure side 72 of compressor 2. Similarly, when the compressor 2 is not in operation, the piston 172 is positioned in a second position, as shown in FIG. 16, which results in the relief valve being open to permit flow of high pressure fluid back to the low pressure side 72 of compressor 2 and results in the discharge valve being closed preventing the high pressure fluid on the high pressure side 70 of the compressor 2 from equalizing with low pressure fluid on the low pressure side of the compressor 2.

For the opening of the discharge valve or the relief valve, the piston 172 has a groove or channel 174. To open the discharge valve, the groove 174 is in fluid communication with both the discharge inlet 164 and the discharge outlet 168 only when the piston 172 is in the first position in the chamber 162. The body of the piston 172 is then used to block the relief inlet 166 and relief outlet 170 when the piston 172 is in the first position in the chamber 162, thereby closing the relief valve. To open the relief valve, the groove 174 is in fluid communication with both the relief inlet 166 and the relief outlet 170 only when the piston 172 is in the second position in the chamber 162. The body of the piston 172 is then used to block the discharge inlet 164 and discharge outlet 168 when the piston 172 is in the second position in the chamber 162, thereby closing the discharge valve. In a preferred embodiment of the present invention, the groove or channel 174 is disposed about the circumference or perimeter of the piston 172. However, the groove or channel 174 can also be disposed through the body of the piston 172 or disposed in any other manner that permits fluid communication between the discharge inlet 164 and the discharge outlet 168 or the relief inlet 166 and relief outlet 170 depending on the position of the piston 172 in the chamber 162.

The pressure equalization system 10 shown in FIGS. 16 and 17 is configured to permit the use of an operating feature of the compressor 2 to apply a force to the piston 172 that urges the piston 172 into the first position. In a preferred embodiment of the present invention, the operating feature used to urge the piston 172 into the first position is the oil pressure in the compressor 2 and more preferably the bearing oil pressure. In another embodiment, the oil pressure can be obtained from the high pressure side of the compressor 2. However, it is to be understood that any operating feature of the compressor 2 (e.g. centrifugal forces or torque from rotating parts of the compressor 2, such as shaft 82, magnetic forces or effects, preferably from parts of the compressor 2 such as a motor stator, or flow of compressed gas) can be used to urge the piston 172 into the first position.

The pressure equalization system 10 further uses a biasing mechanism 176 to position the piston 172 in the second position when the compressor is not in operation. The biasing mechanism 176 is operatively connected to the piston 172 to position the piston 172 into the second position. The biasing mechanism 176 can be configured to pull the piston 172 into the second position as shown in FIGS. 16 and 17, or can be configured to urge or push the piston 172 into the second position in a manner similar to that shown in FIGS. 14 and 15. The biasing mechanism 176 is preferably a spring, and for the embodiment shown in FIGS. 16 and 17 the biasing mechanism is more preferably an extension spring, however, any mechanism that can position the piston 172 into the second position in the chamber 162 when the compressor 2 is not in operation can be used.

In the preferred embodiment of the biasing mechanism 176 using the extension spring, the extension spring is connected to the piston 172 using a bolt, rivet or other similar connection. Additionally, the biasing mechanism 176 can have a spring holder disposed in the chamber 162 to hold the extension spring, while still permitting the operational feature of the compressor 2 to urge the piston 176 into the first position.

To urge the piston 172 into the first position in the chamber 162, there is an opening or inlet 178 in chamber 162 that is in fluid communication with the bearing oil of the compressor 2. When the compressor 2 is operating, the pressure of the bearing oil in the compressor 2 increases, causing the bearing oil in the compressor 2 to enter the chamber 162 through opening 178 and urge the piston 172 into the first position. The pressure of the bearing oil in the chamber 162 is sufficient to overcome any bias or tension of the biasing mechanism 176 and urge the piston 172 into the first position. When the compressor 2 stops operating, the pressure of the oil in chamber 162 decreases as oil drains from the chamber 162 and the bias of the biasing mechanism 176 positions the piston 172 into the second position to open the relief valve, thereby permitting the equalization of the pressure in the compressor 2.

The method for equalizing pressure to permit compressor 2 to start under non-high pressure loading using pressure equalization system 10 will now be described in detail with reference to FIG. 3. When compressor 2 is turned on, the fluid enters compressor 2 at a low pressure vapor state through compressor inlet 16 and into compression chamber 80. As piston 78 compresses the fluid, valve system 84 prevents the fluid from exiting compressor 2 through inlet 16, as previously described. Valve 92 opens under the increasing pressure, permitting the fluid, now at a high pressure vapor state, to discharge through compressor outlet 20 and into inlet 34 of housing 24. The fluid then passes from first portion 30 of housing 24 and through valve 28 into second portion 32 of housing 24. Valve 28 opens due to the pressurized flow of the fluid created by piston 78. The fluid then exits housing 24 through housing outlet 36 on its way to condenser 8, as shown schematically in FIG. 1.

When compressor 2 is turned off, valves 28 and 92 close as piston 78 no longer is compressing and forcing the fluid through compressor outlet 20. Due to the lower fluid pressure, expansion valve 6 also closes. The fluid located downstream from valve 28 in second portion 32 of housing 24 therefore remains at a high pressure vapor state and maintains the high pressure side 70, as shown in FIG. 1. Meanwhile, the fluid at a high pressure vapor state located in first portion 30 of housing 24 bleeds through bleed port 26 back toward compressor inlet 16 and equalizes with the fluid at a low pressure vapor state in compressor inlet 16.

Upon restarting compressor 2, high pressure side 70, as shown in FIG. 1, has remained high due to the high pressure state of the fluid downstream from valve 28. Meanwhile, the fluid upstream from valve 28 is at a lower pressure state following the equalization process. As a result, when piston 78 begins to compress the fluid upon restarting compressor 2, the fluid upstream from valve 28 is at a lower pressure, making it easier for piston 78 to perform compression. At the same time, a high pressure state has been maintained downstream from valve 28, thus the compression cycle is not starting with equalized pressures in the refrigeration system 74 and less work is required to achieve the pressures in the refrigeration system 74 just prior to when the compressor 2 stopped operating. Thus the pressure equalization method and system increases the efficiency of the compressor 2 and the climate control system of which it is a component.

Figure 18:
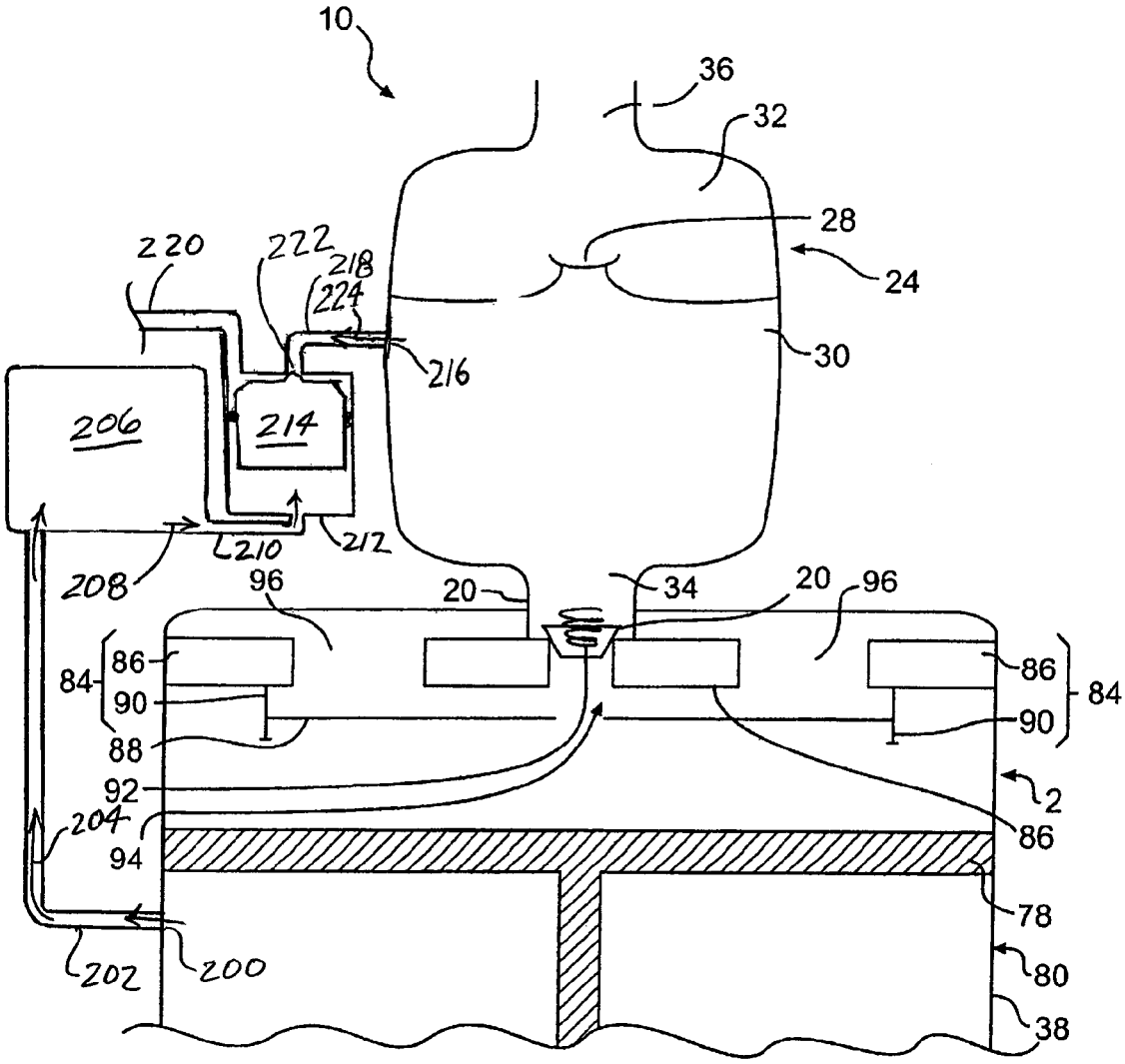
FIGS. 18 and 19 illustrate an alternate embodiment of the pressure equalization system of the present invention.
Figure 19:
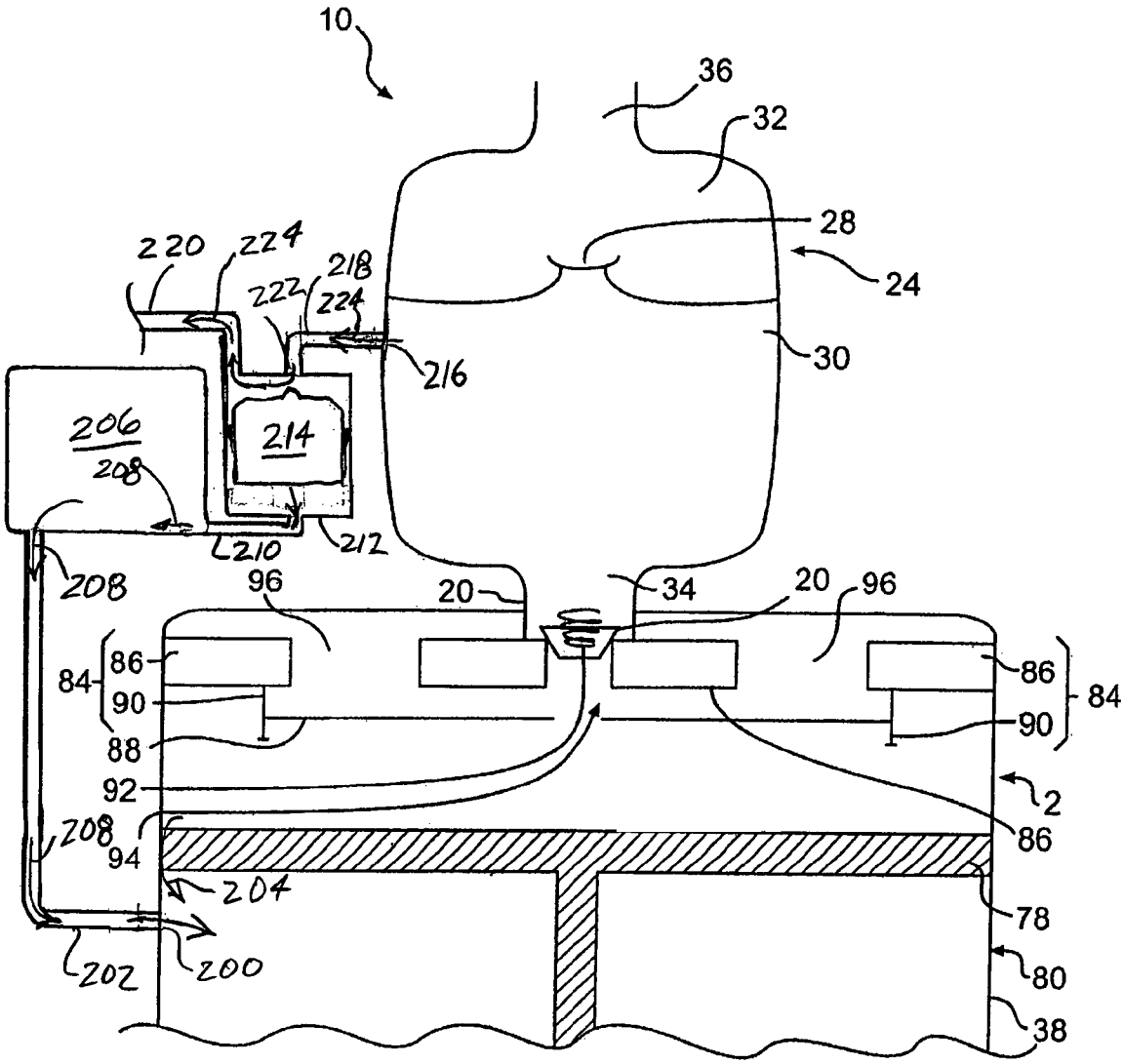
Figure 20:
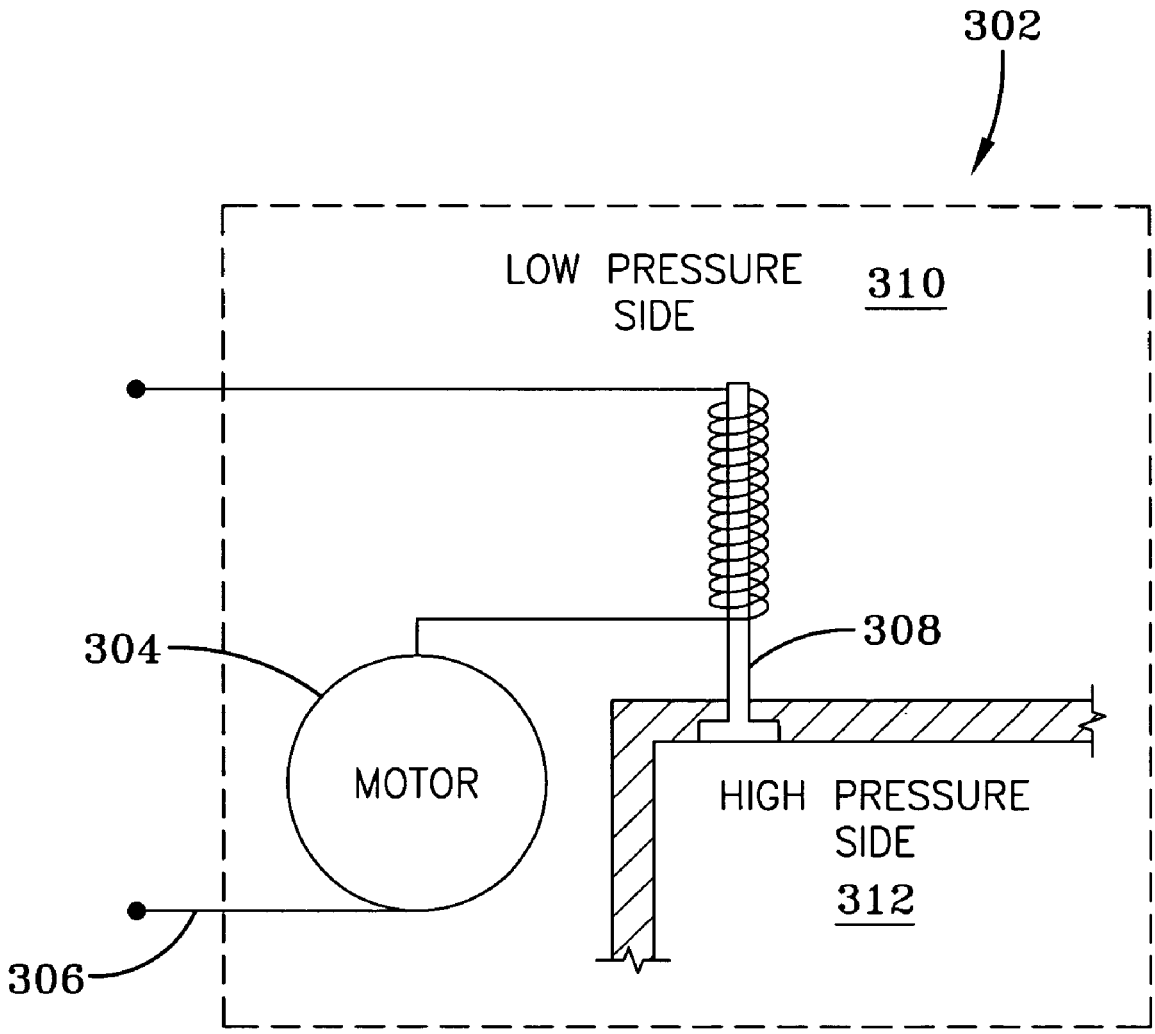
FIG. 20 illustrates an embodiment of an electronically controlled valve used with the pressure equalization system of the present invention.

Referring to FIGS. 18-19, a further embodiment of the pressure equalization system 10 is similar to the embodiment of FIG. 3, except as discussed below. An opening 200 is formed in the wall of the compression chamber 80 that is in fluid communication with a passageway 202 to permit high pressure fluid 204 to flow from the compression chamber 80 to a reservoir 206 when the compressor is in operation. As an example, the magnitude of discharged high pressure fluid 204 can be about 400 psi. However, due to the small size of the opening 200 and the typically brief duration of a compressor operating cycle, the magnitude of fluid pressure in the reservoir 206 only reaches an intermediate pressure that is between the suction pressure and the high pressure discharge, such as about 250 psi. However, it is to be understood that the magnitude of the high and intermediate pressures can vary significantly from these values based on the desired operating parameters of the compressor and the geometries of the compressor components. The intermediate pressure fluid 208 flows through a passageway 210 into a channel 212 that slidably secures a valve member 214 therein. At the opposite end of the channel 212 from the passageway 210, a passageway 218 is in fluid communication with the channel 212 and the first portion 30 of the housing 24. When the compressor is operating, high pressure fluid 224 contained in housing 24 is in fluid communication with the passageway 218 via an opening 216, but the valve member 214 is in abutting contact with an opening 222 between the passageway 218 and the channel 212, blocking the flow of high pressure fluid 224 from flowing past the opening 222.

One having skill in the art appreciates that housing 24 is not required for use in the pressure equalization system 10 of the present invention. There must merely be some connection to the volume which exists between the compressor discharge valve 92 and the valve 28 downstream from the compressor discharge valve 92, because it is this volume containing high pressure gas that must be relieved before the compressor can start. Although this volume is typically in the cylinder head, any volume on the high pressure side of the compressor that is located between two valves of similar operation can be used.

During operation of the compressor, the force exerted on the valve 214 by the intermediate pressure 208 is greater than the opposing force exerted on the valve 214 by the high pressure fluid 224. This is because the area of the valve 214 that is exposed to intermediate pressure 208 is substantially the same as the cross sectional area of the channel 212, which is significantly larger than the area of the valve 214 that is exposed to high pressure fluid 224, or the area of passageway 218. As a result, during operation of the compressor, the valve 214 is urged into movement within the channel 212 toward passageway 218. The valve 214 then contacts the opening 222 between the passageway 218 and the channel 212, forming a substantially fluid tight seal and thereby maintaining the magnitude of the high pressure fluid 224 within housing 24.

However, when the compressor is not operating (FIG. 19), such as between receiving demand signals from the refrigeration system controls, a pressure decay begins to occur within chamber 80. That is, high pressure fluid 204 between the piston 78 and the housing 24 begins to flow past the seal between the piston 78 and the wall of the chamber 80 to an area of reduced pressure, such as the inlet or suction pressure. As the magnitude of pressure is reduced in chamber 80 from that of high pressure fluid 204 to less than that of intermediate pressure fluid 208 in the reservoir 206, intermediate pressure fluid 208 begins to flow from the reservoir 206 along passageway 202 toward chamber 80. Similarly, intermediate pressure fluid 208 begins to flow from channel 212 along passageway 210 toward reservoir 206, reducing the fluid pressure in both channel 212 and reservoir 206. Once the fluid pressure in channel 212 is sufficiently reduced from an intermediate pressure fluid 208 to a sub-intermediate pressure fluid so that the force urging the valve 214 toward opening 222 in passageway 218 is less than the force urging the valve 214 away from opening 222, as described above, valve 214 is urged away from opening 222. By moving the valve 214 away from the opening 222, high pressure fluid 224 is then exposed to the entire surface area of the valve 214, versus the area of the opening 222 of the passageway 218, greatly increasing the force the high pressure fluid 224 exerts on the valve 214, which acts to further urge the valve 214 away from the opening 222. Simultaneously, by urging the valve 214 away from the opening 222, the high pressure fluid 224 from housing 24 flows through passageway 218, enters channel 212, and then flows from channel 212 via line 220 that is in fluid communication with the channel 212 and the suction line, thereby reducing the magnitude of pressurized fluid 224 in housing 24.

The cross sectional areas of the channel 212, the valve 214 and the opening 222 can be sized so that different ranges of fluid pressures may effect movement of the valve 214 within the channel 212. Similarly, the position of the piston 78, and more specifically, the piston ring of the piston 78 with respect to the opening 200 in the chamber 80, can affect the rate of pressure decay in chamber 80. That is, if the position of the piston ring of piston 78 is above the position of the opening 200, the rate of pressure decay in chamber 80 is greater than when the piston ring of piston 78 is below the position of the opening 200. However, in either position, the time required to effect significant pressure decay in chamber 80 does not exceed several minutes, providing sufficient time to substantially reduce the fluid pressure level in housing 24 prior to the next compressor operational cycle.

Referring to FIGS. 20-24, additional embodiments are now discussed for providing pressure equalization to an HVAC system. In these embodiments, compressor 302 includes a motor 304 having electrical leads 306 that are connected to an electrical power source for providing electrical power to the motor 304. A valve 308, such as a solenoid valve, is preferably connected in series with the electrical leads 306, which valve 308 is typically also connected in series with the windings in the motor 304. The valve 308 is connected to the high pressure side 312 of the compressor 302. The term high pressure side 312 can refer to any portion of the compressor associated with high pressure fluid, such as the discharge side of the compression chamber, including the piston cylinder head, muffler, or shock loop. Preferably, when opened, the valve 308 permits high pressure fluid to flow to the low pressure side 310, such as the suction side of the compressor 302. The valve 308 can be of any construction known in the art that is compatible for use with the present invention.

Figure 21:
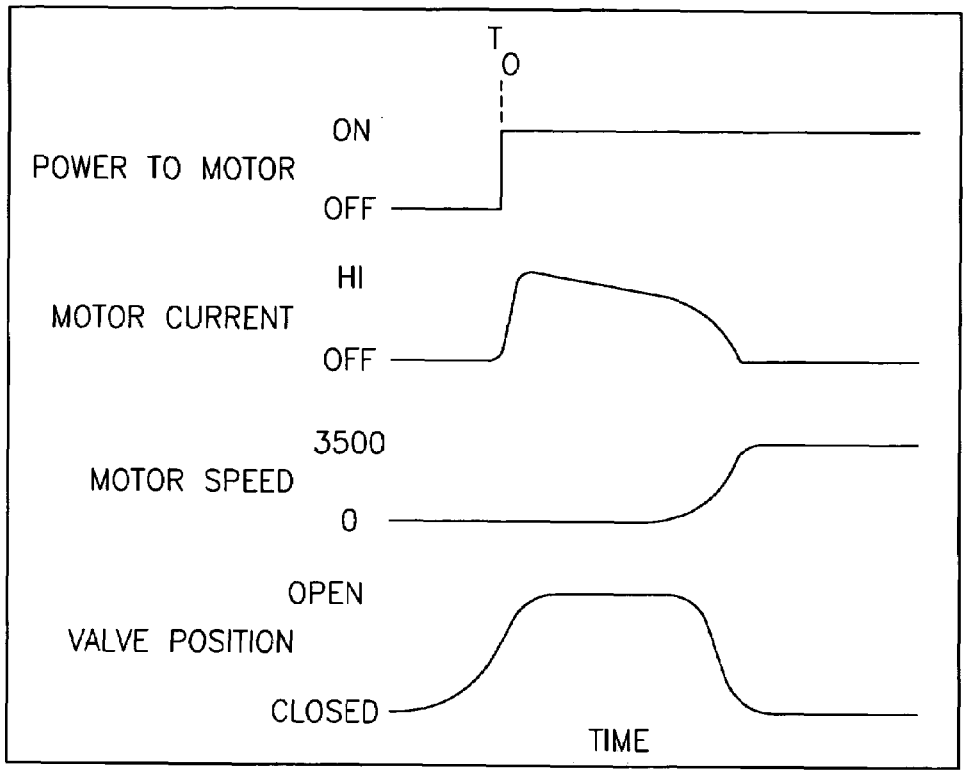
FIGS. 21 and 22 illustrate schematically operating parameters associated with two further alternate embodiments of the pressure equalization system of the present invention.

The valve 308 can be designed to normally be in the "off" or closed condition. In this configuration, as shown in FIG. 21, the valve 308 is normally closed to provide a substantially fluid tight seal to prevent the flow of high pressure fluid from the high pressure side 312 to the low pressure side 310. At an initial time reference, $T_o$, the HVAC system provides electrical power, or electrical current, to the motor 304. To start the motor 304, such as an induction motor, the motor 304 requires a high inrush of electrical current, typically in the range of about 100 amperes, that flows through the electrical leads 306 that feed both the starter windings and main motor windings and the common connection that brings the windings together. The high inrush of electrical current also occurs with motors having "soft starts," although the magnitude of the inrush electrical current would be less, such as about 50 amperes. As the rotational speed of the motor 304 increases to its operating speed, the amount of electrical current required to drive the motor 304 similarly decreases to a substantially constant value. The valve 308 opens in response to the high inrush current, remaining in an open position until the current value drops below a predetermined value, the predetermined current value being greater than that required to drive the motor 304 at its operating speed. Once the valve 308 opens, high pressure fluid from the high pressure side 312 of the compressor flows to the low pressure side 310, the valve 308 being sufficiently sized to permit a rapid change in pressure toward equalization. After this change in pressure occurs, the motor 304 can then accelerate to its operating speed requiring substantially reduced starting torque.

Figure 23:
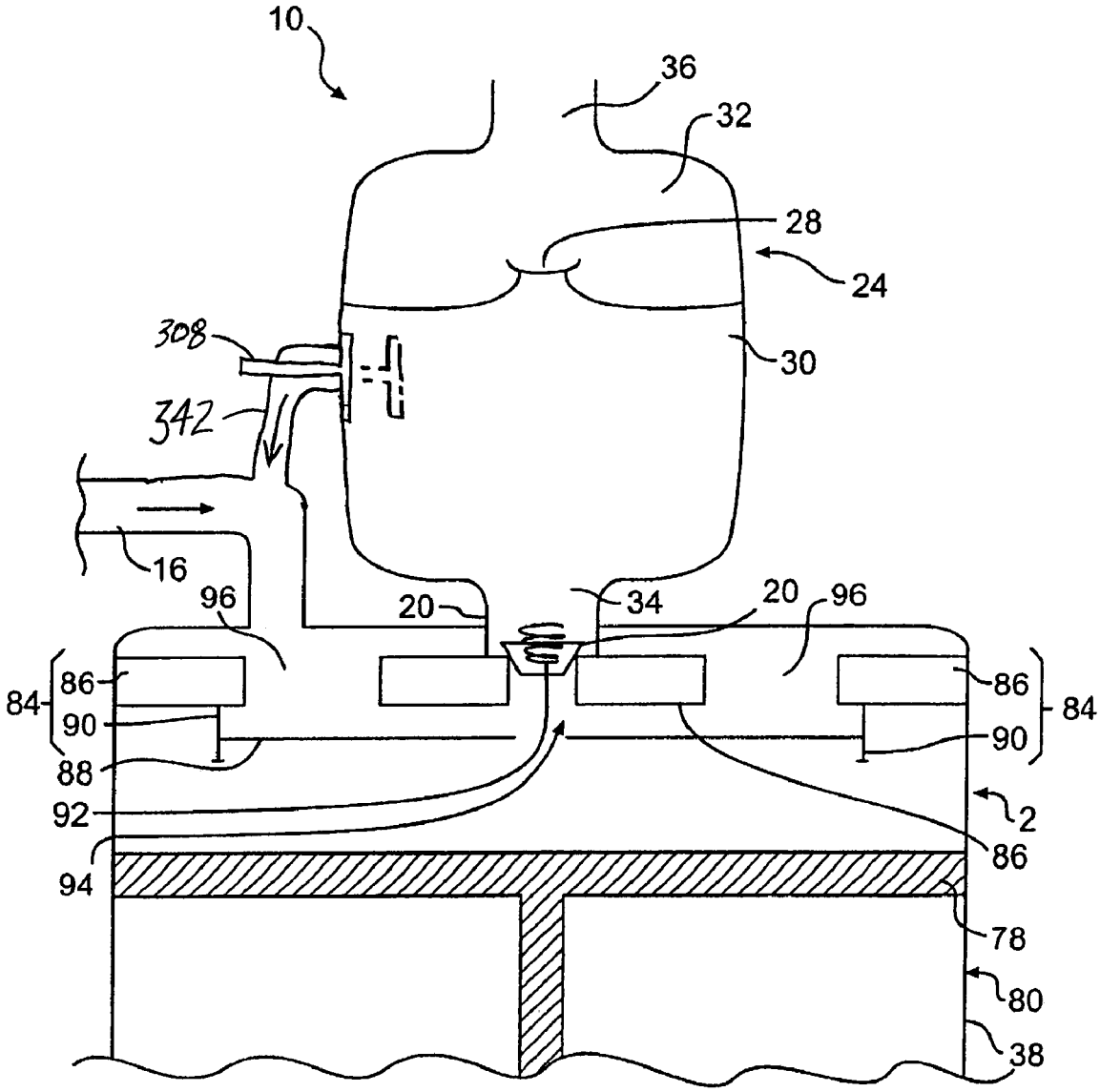
FIGS. 23 and 24 illustrate the respective alternate embodiments of FIGS. 21 and 22 of the pressure equalization system of the present invention.

An embodiment of the normally closed valve 308 is shown in FIG. 23, which is similar to the embodiment shown in FIG. 3, except as shown. Instead of a small connector 42, connector 342 is significantly enlarged, so that upon the valve 308 being actuated to an open position, pressurized fluid in housing 24 rapidly flows within connector 342 to inlet 16, or suction or low pressure side, to rapidly reduce the magnitude of the pressurized fluid remaining in the housing 24. In other words, at $T_o$, and for a predetermined period of time prior to the opening of the valve 308, which is primarily dependent upon the amount of delay the valve 308 requires to actuate, the motor begins its start-up cycle against a significant pressure differential: the discharge side of the pistons being subjected to high pressure fluid. However, once the valve 308 opens, the discharge side of the pistons are subjected to a greatly reduced pressure level. Once the magnitude of the line current supplied to the motor 304 is less than a predetermined level, the valve 308 is actuated to its closed position, allowing the fluid pressure to increase, returning to normal operating levels. Although the embodiment in FIG. 23 includes housing 24, the valve 308 can be secured to any component on the high pressure side, requiring no additional housing.

Figure 22:
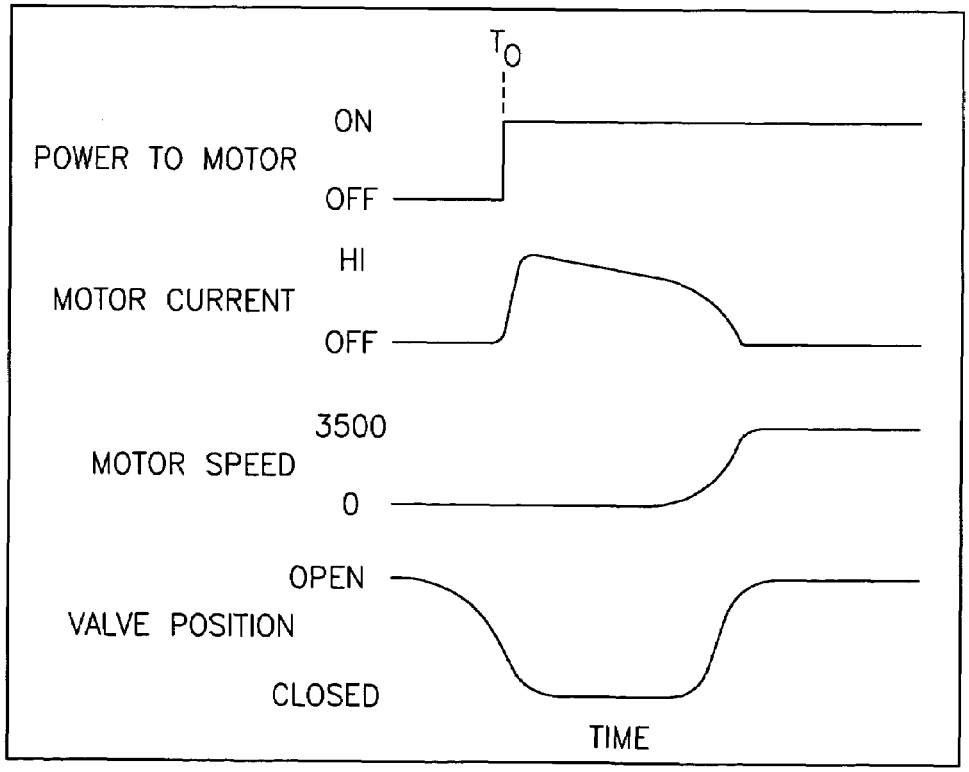
Figure 24:
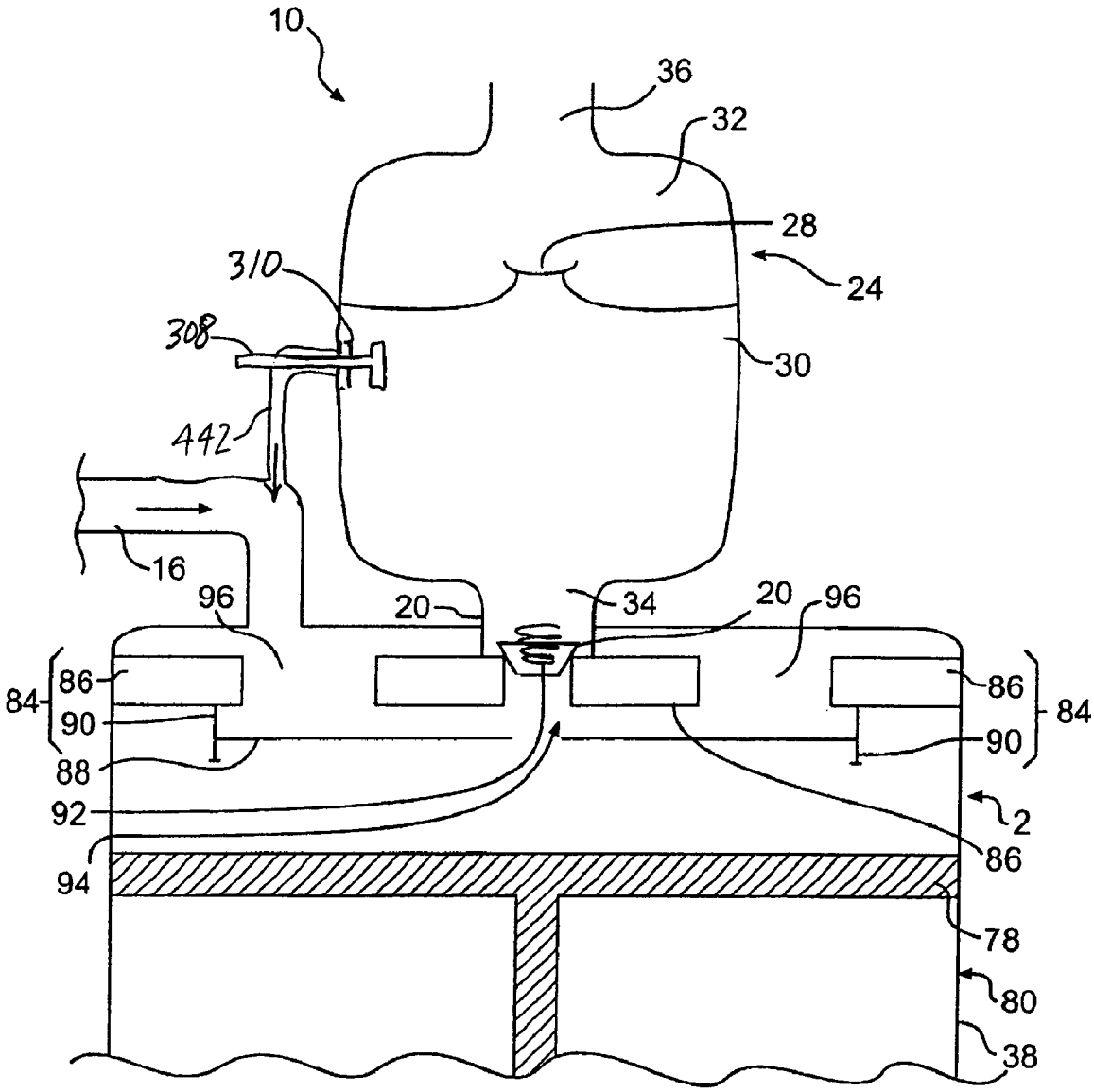

Referring to FIG. 22, which is otherwise similar to FIG. 21, the valve 308 is normally in the "on" or open condition. An embodiment of the normally open valve 308 is shown in FIG. 24, which is similar to the embodiment shown in FIG. 23, except as shown. This valve configuration is 308 is normally open to provide a connection 442 to permit the flow of high pressure fluid from the housing 24 to the compressor inlet 16, or suction or low pressure side. Preferably, the valve 308 and connection 442 is sized so that when the compressor is not operating, i.e., between operating cycles, a substantial amount of high pressure fluid has flowed from the housing 24, significantly reducing the fluid pressure in the housing. By significantly reducing the housing pressure, upon start-up of the motor, after which the valve 308 closes, the motor requires substantially reduced starting torque. However, the housing 24 must be sufficiently sized, along with other considerations, such as valve actuation delay, to ensure the housing 24 does not become overly pressurized before motor has reached its operating speed.

One skilled in the art can appreciate that the valve 308 can be positioned inside the housing 24 previously discussed. The valve 308, by virtue of its operation based on its response to predetermined electrical current ranges, is self-controlled.

Figure 25:
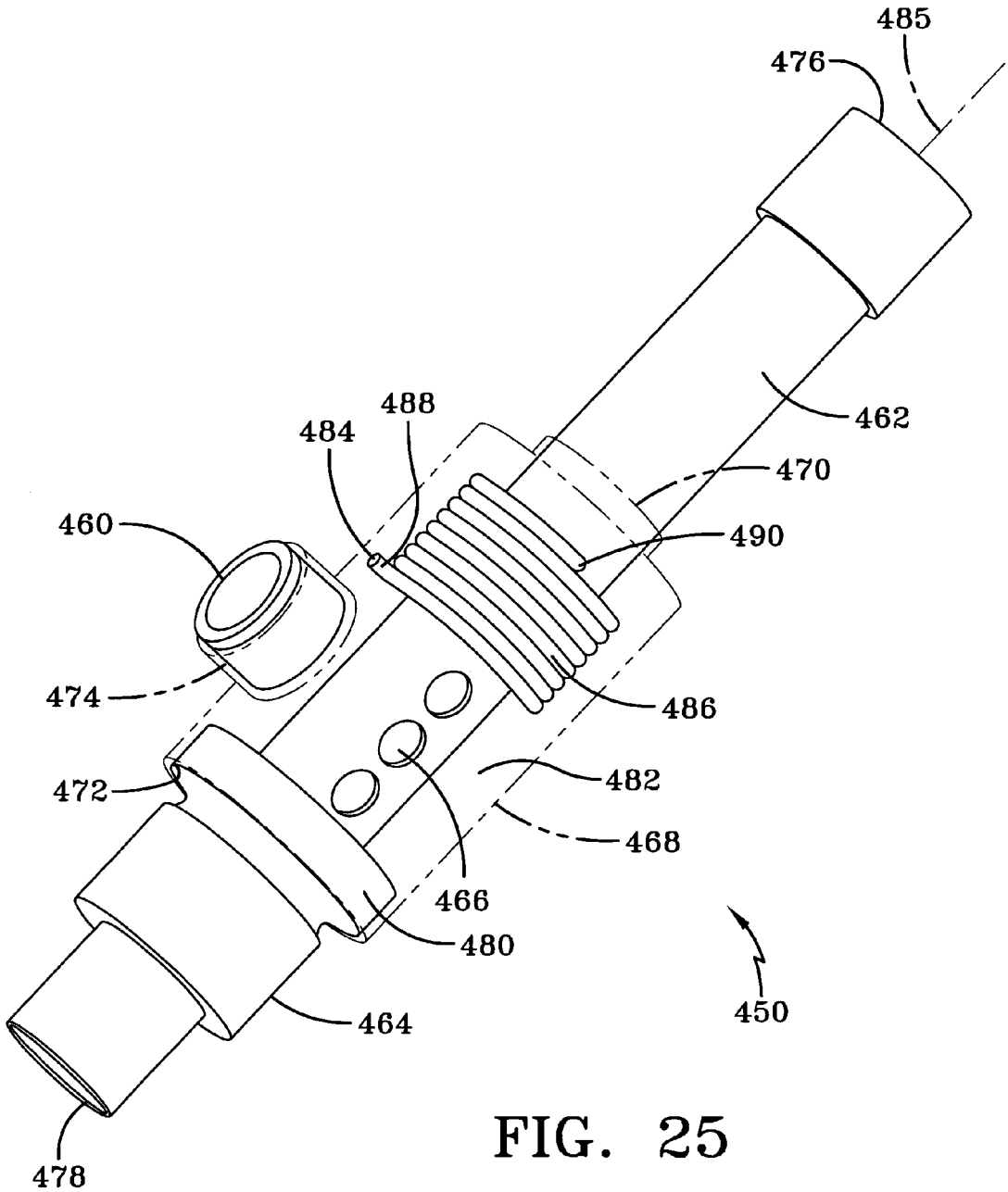
FIG. 25 illustrates an embodiment of a muffler incorporating the pressure equalization system of the present invention.

Referring to FIG. 25, muffler 450 helps regulate cyclic gas surges by employing a relief valve 460, such as an internal pressure relief valve (IPRV) to prevent excessive levels of fluid pressure from accumulating within the muffler 450. Muffler 450 preferably includes a tube 462 having opposed ends 476, 478. A threaded member 464 having a lip 480 at one end is positioned over end 478 of tube 462 for threadedly engaging the cylinder head (not shown) to maintain tube 462 in fluid communication with the gas discharge port of the cylinder head. Preferably, the end 478 of tube 462 and the end of threaded member 464 opposite lip 480 are substantially coincident to ensure the parts are sufficiently engaged therebetween. Alternately, threaded portion 464 may be integrally formed with tube 462 or tube 462 may have external threads formed along its length, wherein housing opening 472 would be similarly sized with that of housing opening 470 so that the external threads of tube 462 would just slide inside the housing openings 470, 472 for ease of securing the housing openings 470, 472 of housing 468 to the tube 462. A housing 468 includes opposed openings 470, 472 which permits opening 470 of housing 468. to be positioned over end 478 of tube 462 and moved along tube 462 until opening 472 of housing 468 is in a position to sufficiently contact lip 480 when assembled. Preferably, housing 468 is coaxial with tube 462 along axis 485. Alternatively, housing 468 and threaded portion 464 may be of unitary construction. Methods of securing tube 462, housing 468 and threaded portion 464 into their respective positions can include spot welding, soldering, brazing, or by press-fit. Housing 468 is substantially cylindrical in profile and defines an annular chamber 482 between tube 462 and housing 468. Tube 462 and housing 468 are preferably maintained in fluid communication by a number of apertures 466, such as three, formed in tube 462. However, any number of apertures 466 can be used to maintain this fluid connection.

The IPRV 460 typically employs (within a cylindrical valve body) a spring (not shown) that is maintained in a compressed condition against a plunger (not shown). The plunger overcomes the directed spring force and actuates toward an open position in the valve body of the IPRV 460 in response to excessive discharge gas pressure levels until sufficient discharge gas is bled through the IPRV 460, wherein the plunger returns to its closed position within the valve body. The IPRV 460 is shown in the muffler 450, although the IPRV 460 may also be positioned downstream of the muffler, such as along the discharge tube (not shown).

Muffler 450 further provides for the integral mounting of IPRV 460 therein. A boss 474 preferably is formed in housing 468, which extends outwardly or inwardly from housing 468 such as by extrusion or other suitable techniques, permitting IPRV 460 to be secured therein by any usual method known in the art such as press fit, threading, adhesive or metal-joining processes involving elevated temperatures. Preferably, boss 474 extends radially outward from axis 485 which defines a side branch mounting for IPRV 460 that saves further space within the compressor housing 416. Alternately, an aperture may be formed in housing 468 without boss 474 that is sized to receive the IPRV 460. In addition to the space savings made possible by the integral muffler/IPRV construction, due to the pair of apertures 466 formed in tube 462 being in fluid communication with chamber 482 of housing 468, the pressure pulses from the discharge port are dampened, thus significantly reducing the number of IPRV 460 "actuations" to resolve such over-pressure conditions. Among the over-pressure conditions causing IPRV 460 actuations are compressor start-ups and changes in compressor operating conditions. The noise generated by the IPRV 460 is generally considered undesirable.

Pressure equalization of the system 10 is achieved by the formation of a bleed port 484 in the housing 468 of the muffler 450 and the incorporation of a check valve in the high pressure portion of the compressor. In one embodiment, a predetermined length of a tube 486, such as a capillary tube, is wound around the tube 462, one end 490 of the tube 486 being inside the housing 468, while the other end 488 of the tube 486 extends through the bleed port 484 in the housing 468. In this embodiment, high pressure fluid in the housing 468 enters the end 490, flows the length of the tube 486 prior to being discharged from the end 488 to the inside of the compressor. Alternately, the tube 486 or any portion thereof can be outside the housing 468. It is preferable that the tube 486 has a diameter in the range of about 0.005 inch to about 0.050 inch, and more preferably about 0.020 inch, and a length of from about six inches to about ten feet, and more preferably about 48 inches. Preferably, both the length and the cross sectional area of the tube 486 are sized so that once the compressor is not operating, such as after the compressor has completed a cooling cycle within a structure, a sufficient amount of the high pressure fluid inside the housing 468 flows through the tube 486 to achieve pressure equalization as previously discussed. The tube 486 can be constructed of copper, stainless steel or any other material of sufficient strength that is compatible with closed refrigeration systems. In other embodiments, the tube 486 can be connected to a shock loop, the cylinder head, or any position along the high pressure discharge portion of the compressor.

Figure 26:
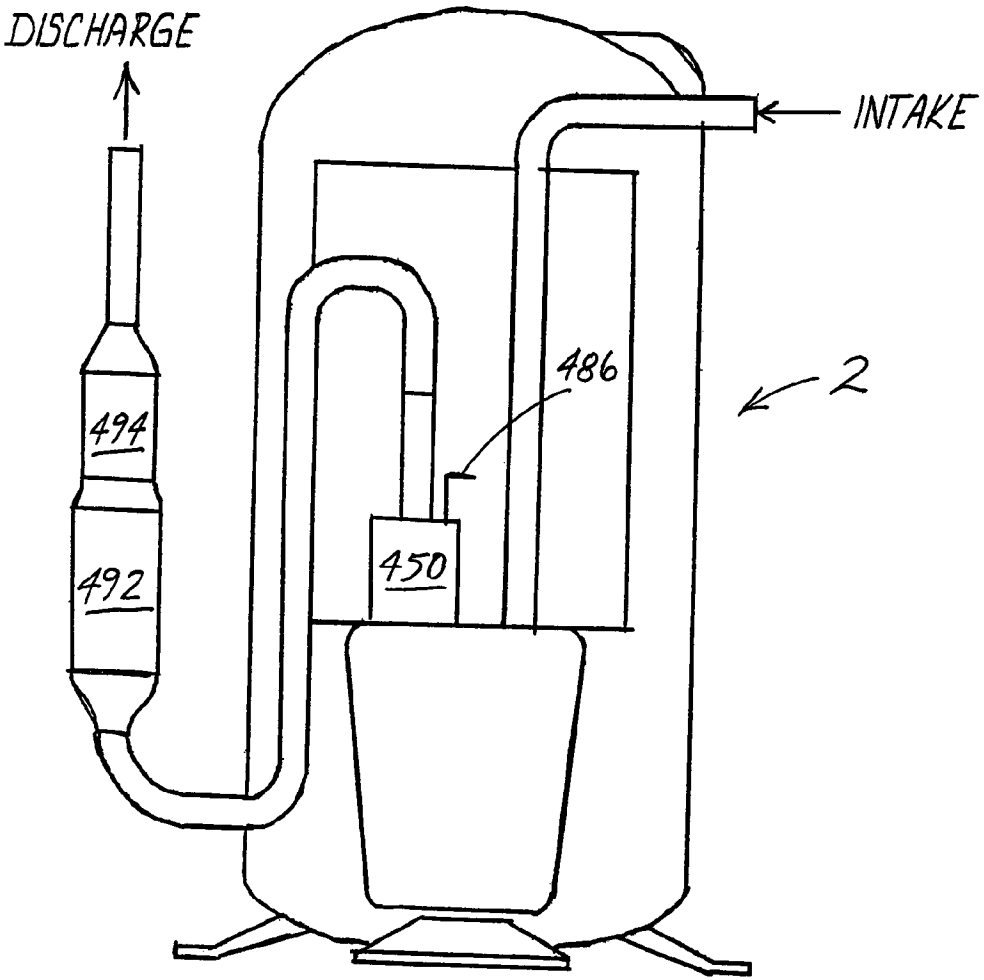
FIG. 26 illustrates an embodiment of a compressor having an internal bleed muffler and an external check valve of the pressure equalization system of the present invention.

In a preferred embodiment shown in FIG. 26, the check valve is not disposed inside of the compressor 2. Instead, a check valve 494 is associated with a second muffler 492, both of which are disposed external of the compressor 2.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A climate control system having a high pressure side and a low pressure side, wherein a fluid flowing through the climate control system changes state between a vapor state and a liquid state to provide climate control, the climate control system comprising:

a compressor being operable to compress a fluid at a low pressure to a high pressure, the compressor comprising an inlet portion to receive fluid at a low pressure from a low pressure side of the system, a compression chamber for compression of fluid, and an outlet portion to provide fluid at a high pressure to a high pressure side of the system; and a pressure equalization system operatively connected to the compressor, the pressure equalization system being configured to equalize pressure between the inlet portion and the outlet portion of the compressor in response to the compressor not being in operation, the pressure equalization system comprising:

a first inlet connection, the first inlet connection being in fluid communication with the outlet portion of the compressor;

a check valve configured and disposed downstream of the outlet portion and in fluid communication with the outlet portion;

a first outlet connection, the first outlet connection being in fluid communication with the inlet portion of the compressor;

a chamber, the chamber being in fluid communication with the first inlet connection and the first outlet connection;

a piston slidably disposed within the chamber between a first position and a second position, wherein the piston prevents fluid flow between the first inlet connection and the first outlet connection through the chamber upon being in the first position and the piston permits fluid flow between the first inlet connection and the first outlet connection through the chamber upon being in the second position;

a second inlet connection, the second inlet connection being configured and disposed to provide a passage for fluid between the compression chamber of the compressor and the chamber; and wherein the piston being positioned in the first position in the chamber in response to the compressor being in operation, and the piston being positioned in the second position in the chamber in response to the compressor not being in operation, the piston being movable between the first position and the second position by a fluid force differential between the first inlet connection and the second inlet connection, thereby permitting fluid at a high pressure to flow through the first inlet connection to the first outlet connection to equalize pressure in the compressor when the compressor is not operating.

2. The climate control system of claim 1 wherein the piston comprises a valve arrangement to seal the first inlet connection.

3. The climate control system of claim 2 wherein the valve arrangement is a protrusion.

4. The climate control system of claim 1 wherein the second inlet connection comprises a reservoir interposed between and in fluid communication with the second inlet connection and the chamber.

5. The climate control system of claim 1 wherein the chamber is disposed internal of the compressor.

6. The climate control system of claim 1 wherein high pressure fluid from the compression chamber flows in the second inlet connection to urge the piston into the first position when the compressor is in operation.

7. The climate control system of claim 1 wherein high pressure fluid from the compressor flows in the first inlet to urge the piston into the second position when the compressor is not operating.

8. A climate control system having a high pressure side and a low pressure side, wherein a fluid flowing through the climate control system changes state between a vapor state and a liquid state to provide climate control, the climate control system comprising:

a compressor being operable to compress a fluid at a low pressure to a high pressure, the compressor comprising an inlet portion to receive fluid at a low pressure from the low pressure side of the system and an outlet portion to provide fluid at a high pressure to the high pressure side of the system; and a pressure equalization system operatively connected to the compressor, the pressure equalization system being configured to equalize pressure between the inlet portion and the outlet portion of the compressor in response to a start-up operation of the compressor, the pressure equalization system comprising:

a first inlet for fluid, the first inlet for fluid being in fluid communication with the outlet portion of the compressor;

a first outlet for fluid, the first outlet for fluid being in fluid communication with the inlet portion of the compressor;

a valve member operably disposed with respect to the first inlet between a first position and a second position, wherein the first inlet and the first outlet are not in fluid communication upon the valve member being in the first position and the first inlet is in fluid communication with the first outlet upon the valve member being in the second position;

means for moving the valve member with respect to the first inlet between the first position and the second position; and wherein the means for moving the valve member with respect to the first inlet positions the valve member in the second position in response to a current being provided to the compressor greater than a first predetermined current level, thereby permitting fluid at a high pressure to flow through the first outlet to the inlet portion of the compressor to equalize pressure in the compressor.

9. The climate control system of claim 8 wherein the first inlet is disposed internal of the compressor.

10. The climate control system of claim 8 wherein the first predetermined current level being less than an inrush current associated with start-up of the compressor.

11. The climate control system of claim 8 wherein the first predetermined current level being associated with operation of the compressor.

12. The climate control system of claim 11 wherein the valve member comprises a valve disposed in the second position in response to the current being greater than the first predetermined level.

13. The climate control system of claim 11 wherein the valve member comprises a valve disposed in the second position in response to the current being less than a predetermined level.

14. The climate control system of claim 8 wherein the means for moving the valve member comprises means for moving the valve member into the first position in response to a current being provided to the compressor greater than a first predetermined current level, the first predetermined current level being associated with start-up of the compressor.

15. The climate control system of claim 8 wherein the means for moving the valve member comprises means for moving the valve member into the second position in response to a current being provided to the compressor greater than a first predetermined current level, the first predetermined current level being less than an inrush current associated with start-up of the compressor.

16. A pressure equalization system for a compressor operable to compress a fluid at a first pressure to a second pressure greater than the first pressure, the system comprising:

a discharge arrangement, the discharge arrangement being configured and disposed to receive fluid at a second pressure from a compression device in the compressor;

a check valve disposed in the discharge arrangement and configured to permit fluid at the second pressure to flow through the check valve when the compressor is in operation and to prevent fluid at the second pressure from flowing through the check valve when the compressor is not in operation;

a bleed system disposed in the discharge arrangement upstream of the check valve and configured to provide a continuous flow of fluid from the discharge arrangement to a low pressure portion of the compressor at the first pressure, the bleed system comprises a passageway of a predetermined size and predetermined length in fluid communication with the discharge arrangement; and wherein the passageway being sized to equalize pressure in the compressor between the low pressure portion of the compressor and the discharge arrangement upstream of the check valve when the compressor is not in operation, the passageway being sized not to impact compressor efficiency when the compressor is in operation.

17. The pressure equalization system of claim 16 wherein the passageway comprises a tube disposed internal of the compressor.

18. The pressure equalization system of claim 17 wherein the tube is a capillary tube.

19. The pressure equalization system of claim 16 wherein the predetermined length of the passageway is between about six inches and about ten feet.

20. The pressure equalization system of claim 18 wherein the predetermined length of the tube is between about 24 inches and about 48 inches.

21. The pressure equalization system of claim 18 wherein the predetermined diameter of the tube is between about 0.005 inch and about 0.050 inch.

22. The pressure equalization system of claim 18 wherein the predetermined diameter of the tube is about 0.020 inch.

23. The pressure equalization system of claim 17 wherein the discharge arrangement comprises a muffler, and the passageway is connected to the muffler.

24. The pressure equalization system of claim 23 wherein the passageway originates inside the muffler and extends outside the muffler.

25. The pressure equalization system of claim 23 wherein the passageway is disposed internal of the muffler.

26. The pressure equalization system of claim 16 wherein the check valve is external to the compressor.

27. The pressure equalization system of claim 16 wherein the discharge arrangement comprises a shock loop, and the passageway is connected to the shock loop.

* * * * *